US007637679B2

(12) United States Patent
May et al.

(10) Patent No.: US 7,637,679 B2
(45) Date of Patent: Dec. 29, 2009

(54) DISPENSER AND PROCESS

(75) Inventors: Richard J. May, Saylorsburg, PA (US); Francesca Fazzolari, Hackettstown, NJ (US); David G. Robinson, Newton, NJ (US); Alexander T. Davidson, Sparta, NJ (US)

(73) Assignee: James Alexander Corporation, Blairstown, NJ (US)

( * ) Notice: Subject to any disclaimer, the term of this patent is extended or adjusted under 35 U.S.C. 154(b) by 0 days.

(21) Appl. No.: 11/846,849

(22) Filed: Aug. 29, 2007

(65) Prior Publication Data

US 2007/0292195 A1 Dec. 20, 2007

Related U.S. Application Data

(62) Division of application No. 10/999,892, filed on Nov. 30, 2004, now Pat. No. 7,581,899.

(51) Int. Cl.
*B43K 5/14* (2006.01)

(52) U.S. Cl. ..... 401/133; 401/132; 604/3

(58) Field of Classification Search ..... 401/132–136; 604/3

See application file for complete search history.

(56) References Cited

U.S. PATENT DOCUMENTS 1,105,457 A 7/1914 Roberts
1,229,195 A 6/1917 Hamilton
1,332,985 A 3/1920 Jarrett
1,587,598 A 6/1926 Magg
1,822,566 A 9/1931 Davies
2,058,251 A 10/1936 Nitardy et al.
2,311,367 A 2/1943 Chambers
2,371,667 A 3/1945 Arena et al.
2,517,604 A 8/1950 Smith
2,546,848 A 3/1951 Bishop
2,681,168 A 6/1954 McMillion
2,832,087 A 4/1958 McEwan
3,029,987 A 4/1962 Gronemeyer
3,124,828 A 3/1964 Barber et al.
3,152,352 A 10/1964 Kosik, Jr.
3,216,562 A 11/1965 Lockwood
3,248,017 A 4/1966 Allen (Continued)

FOREIGN PATENT DOCUMENTS

DE 3246406 A1 6/1984

(Continued)

OTHER PUBLICATIONS

Quidel Corporation, QuickVue In-Line Strep A test, Instruction Literature, 0563112 (Mar. 2003).

*Primary Examiner*—David J Walczak
(74) *Attorney, Agent, or Firm*—Banner & Witcoff, Ltd.

(57) ABSTRACT

A dispenser for dispensing a flowable material has a container having a side wall and further having a closed end and an open end. A membrane defines a chamber within the container between the membrane and the closed end of the container. The membrane has a weld seam rupturable upon the application of a force to a side wall of the container proximate the membrane. A swab assembly is operably connected to the open end of the container such that the swab assembly is in flow communication with the open end.

13 Claims, 13 Drawing Sheets

U.S. PATENT DOCUMENTS 3,369,543 A 2/1968 Ronco
3,399,020 A 8/1968 Margolis et al.
3,457,014 A 7/1969 Ward
3,481,513 A 12/1969 Ram
3,482,920 A 12/1969 Schwartzman
3,521,637 A 7/1970 Waterbury
3,584,211 A 6/1971 Rauhut
3,614,245 A 10/1971 Schwartzman
3,636,922 A 1/1972 Ketner
3,658,719 A 4/1972 McConnaughey
3,684,136 A 8/1972 Baumann
3,702,677 A 11/1972 Heffington
3,741,383 A 6/1973 Wittwer
3,757,782 A 9/1973 Aiken
3,759,259 A 9/1973 Truhan
3,831,742 A 8/1974 Gardella et al.
3,856,138 A 12/1974 Maekawa et al.
3,876,314 A 4/1975 Nehring
3,891,331 A 6/1975 Avery
3,896,552 A 7/1975 Russell
3,896,808 A 7/1975 Szpur
3,924,623 A 12/1975 Avery
3,964,643 A 6/1976 Morane et al.
4,023,580 A 5/1977 Pieters
4,058,425 A 11/1977 Thrun
4,095,596 A 6/1978 Grayson
4,106,652 A 8/1978 Leclabart
4,121,746 A 10/1978 Frohlich et al.
4,183,684 A 1/1980 Avery, Jr.
4,342,395 A 8/1982 Brown
4,378,069 A 3/1983 Franco
4,432,530 A 2/1984 Marcinek
4,432,749 A 2/1984 Snyder et al.
4,441,227 A 4/1984 d'Argembeau
4,452,262 A 6/1984 Jankewitz
4,572,689 A 2/1986 Chernack
4,620,648 A 11/1986 Schwartzman
4,622,985 A 11/1986 Jankewitz
4,625,140 A 11/1986 Gagnon
4,657,134 A 4/1987 Woodworth et al.
4,674,903 A 6/1987 Chen
4,696,393 A 9/1987 Laipply
4,765,518 A 8/1988 O'Meara
4,780,083 A 10/1988 Croll
4,844,641 A 7/1989 Grosfilley et al.
4,867,326 A 9/1989 O'Meara
4,872,556 A 10/1989 Farmer
4,875,602 A * 10/1989 Chickering et al. ..... 222/187
4,884,703 A 12/1989 O'Meara
4,927,012 A 5/1990 Rowe
4,940,350 A 7/1990 Kim
4,942,330 A 7/1990 Karlotski et al.
4,946,389 A 8/1990 Weissenburger
4,952,204 A 8/1990 Korteweg
4,973,181 A 11/1990 Jankewitz
4,978,504 A 12/1990 Nason
4,984,381 A 1/1991 Seifert
4,990,016 A 2/1991 Seidler
5,002,198 A 3/1991 Smith
5,035,348 A 7/1991 Seifert
5,038,455 A 8/1991 Guest
5,042,690 A 8/1991 O'Meara
5,052,589 A 10/1991 O'Meara
5,054,948 A 10/1991 Honda et al.
5,078,968 A 1/1992 Nason
5,098,297 A 3/1992 Chari et al.
5,100,028 A 3/1992 Seifert
5,114,240 A 5/1992 Kindt-Larsen et al.
5,118,291 A 6/1992 Varaine
5,133,458 A 7/1992 Miller
5,152,742 A 10/1992 Simpson
5,154,525 A 10/1992 Matsuo
5,169,030 A 12/1992 Lewin
5,172,807 A 12/1992 Dragan et al.
5,180,242 A 1/1993 De Laforcade
5,208,010 A 5/1993 Thaler
5,215,219 A 6/1993 Gallagher
5,228,593 A 7/1993 O'Meara
5,229,061 A 7/1993 Van Dyke et al.
5,236,355 A 8/1993 Brizzolara et al.
5,238,649 A 8/1993 Nason
5,244,120 A 9/1993 O'Meara
5,266,266 A 11/1993 Nason
5,269,441 A 12/1993 O'Meara
5,288,159 A 2/1994 Wirt
5,301,837 A 4/1994 O'Meara
5,326,603 A 7/1994 Van Dyke et al.
5,337,764 A 8/1994 McKay
5,376,006 A 12/1994 Fischer
5,378,226 A 1/1995 Hanifl et al.
5,379,898 A 1/1995 Joulia
5,419,450 A 5/1995 Guglielmelli et al.
5,490,736 A * 2/1996 Haber et al. ..... 401/40
5,529,224 A 6/1996 Chan et al.
5,611,687 A 3/1997 Wagner
5,664,705 A 9/1997 Stolper
5,714,059 A 2/1998 Seifert et al.
5,735,437 A 4/1998 Broyles et al.
5,743,736 A 4/1998 Folko et al.
5,791,801 A 8/1998 Miller
5,826,600 A 10/1998 Rowe et al.
5,853,388 A 12/1998 Semel
5,869,003 A 2/1999 Nason
5,879,635 A 3/1999 Nason
5,924,605 A 7/1999 Baudin et al.
5,992,692 A 11/1999 Boissay
6,007,529 A 12/1999 Gustafsson et al.
6,036,005 A 3/2000 Krause et al.
6,039,488 A 3/2000 Krawczyk et al.
6,092,535 A 7/2000 Moore
6,156,208 A 12/2000 Desjardins et al.
6,189,688 B1 2/2001 Aneas
6,248,294 B1 6/2001 Nason
6,283,933 B1 9/2001 D'Alessio et al.
6,315,480 B1 * 11/2001 Martel et al. ..... 401/132
6,364,197 B1 4/2002 Oelgoetz et al.
6,379,069 B1 4/2002 May
6,419,414 B1 7/2002 Broyles et al.
6,425,704 B2 7/2002 Voiers et al.
6,478,191 B1 11/2002 D'Alessio et al.
6,516,947 B1 2/2003 Van Dyke et al.
6,517,350 B2 2/2003 Diasti et al.
6,595,940 B1 7/2003 D'Alessio et al.
6,641,319 B2 11/2003 May
6,655,551 B2 12/2003 Manne
6,705,790 B2 3/2004 Quintero et al.
6,729,786 B1 * 5/2004 Tufts et al. ..... 401/133
6,755,586 B1 6/2004 Frazier
6,976,494 B2 12/2005 Wayne et al.
2003/0028156 A1 2/2003 Juliar
2004/0092883 A1 5/2004 Casey, II et al.

FOREIGN PATENT DOCUMENTS

EP 0463658 A1 1/1992
FR 2700698 A1 7/1994
JP 06156513 A 6/1994
NL 8602366 4/1988
WO 8809753 A1 12/1988

* cited by examiner

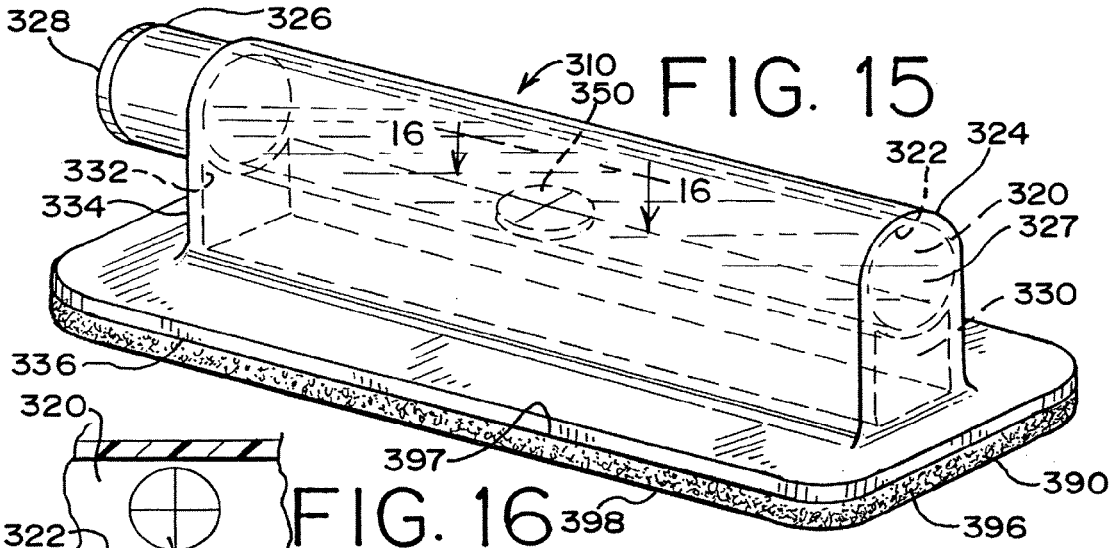
FIG. 15
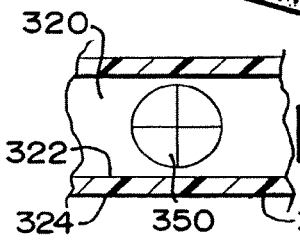
FIG. 16
FIG. 17
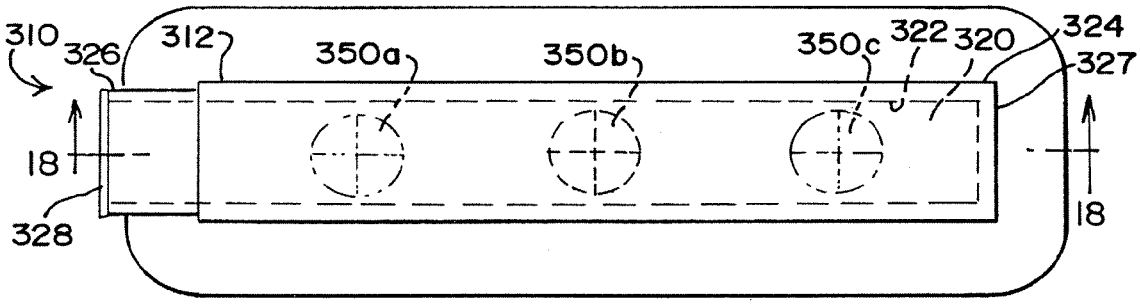
FIG. 18
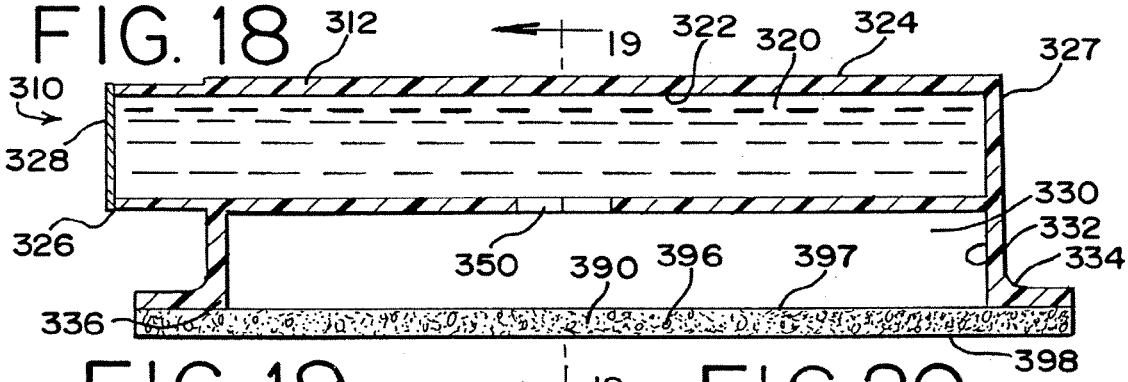
FIG. 19
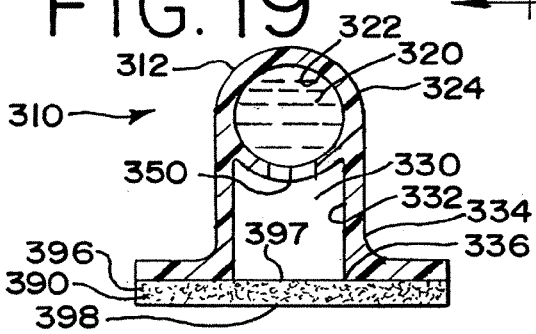
FIG. 20
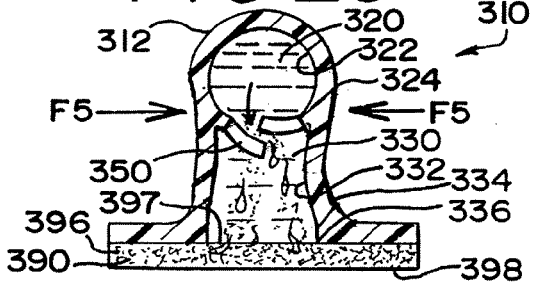

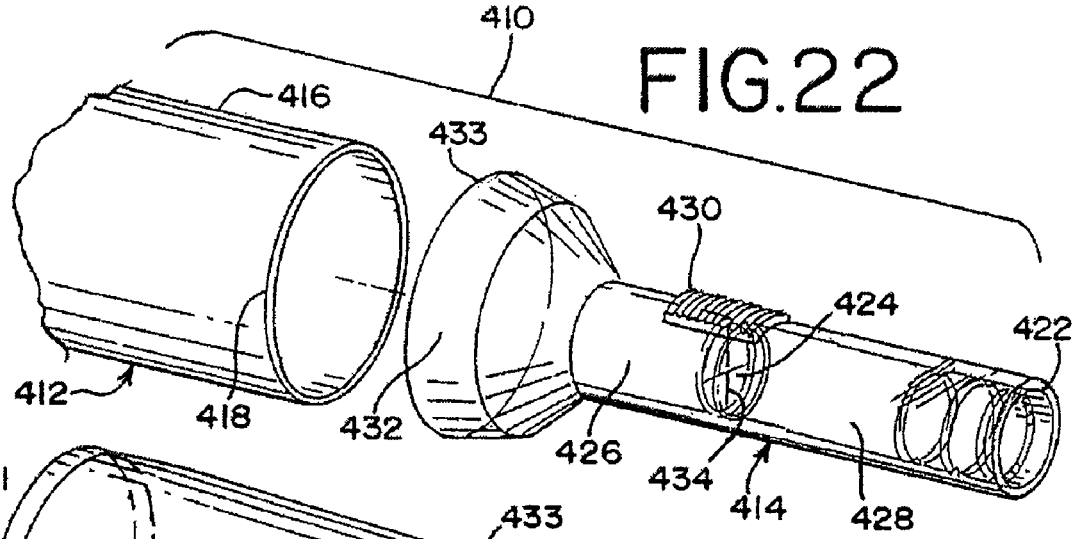
FIG.22
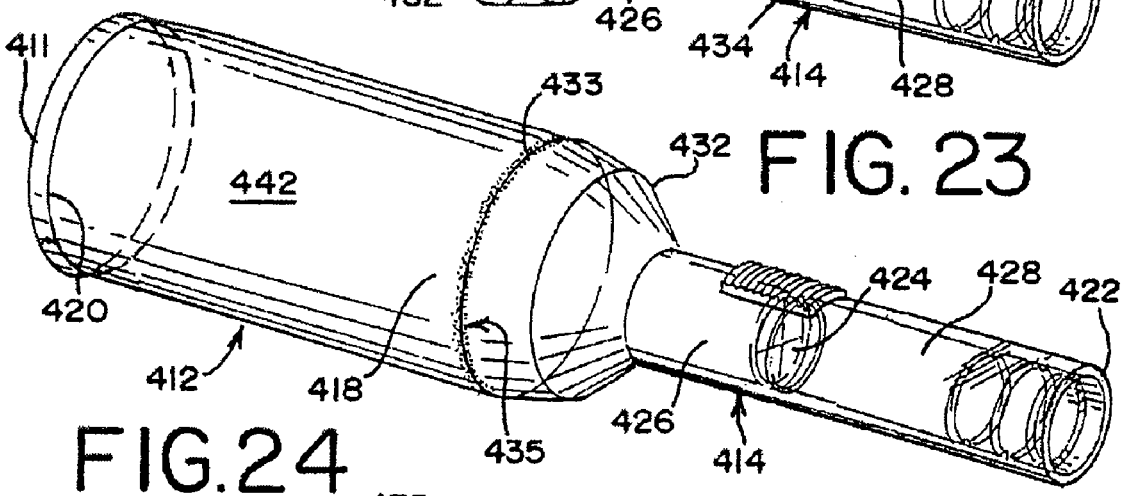
FIG. 23
FIG.24
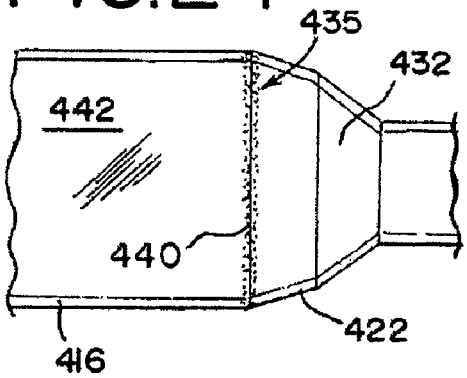
FIG.25
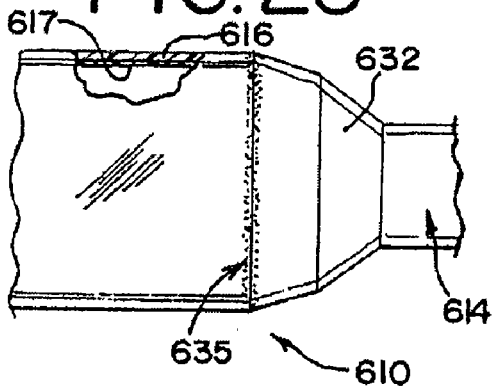
FIG.26
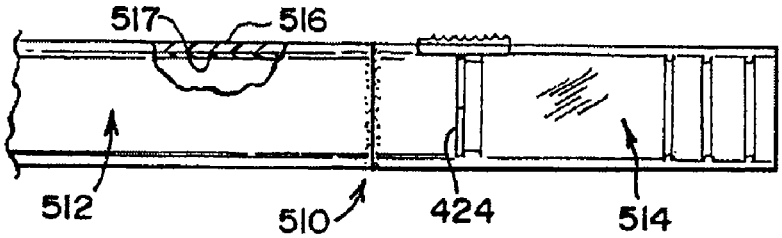

DISPENSER AND PROCESS

RELATED APPLICATION

This application is a divisional of and claims priority to co-pending prior U.S. application Ser. No. 10/999,892, filed Nov. 30, 2004, which application is expressly incorporated herein by reference and made a part hereof.

FEDERALLY SPONSORED RESEARCH OR DEVELOPMENT

Not applicable.

TECHNICAL FIELD

The invention generally relates to a dispenser for flowable materials and, in particular, the invention relates to a fluid dispenser having multiple chambers separated by a membrane.

BACKGROUND OF THE INVENTION

Different types of containers and dispensers for the distribution of material are known within the packaging industry. One example is described in U.S. Pat. No. 3,759,259 issued Sep. 18, 1973 to Andrew Truhan. The Truhan patent discloses a combination applicator and container for medicinal substances. The applicator includes a holder and a fibrous wadding of cotton. The container has flexible walls and a flat seal that spans the container opening. The flat seal is heat sealed to the interior surface of the container. The flat seal is perpendicular to the flexible walls and ruptures upon the application of inward force to the container side walls. In all of these embodiments, the flat seal includes one or more score lines which form lines of weakness or burst lines when an inward force F is applied to the container side walls.

U.S. Pat. No. 3,684,136 to Baumann discloses a receptacle for receiving and mixing liquid and/or solid substances. The receptacle includes a lower mixing chamber M, an upper secondary chamber S, and a foil dividing wall. The lower surface of the dividing wall is convex and the top surface of the wall is concave. In the first embodiment, the surface of the dividing wall features a scored notch or notches, that signifies a weakened portion of the dividing wall. The notches can be arranged in a star or cross orientation. To tear the dividing wall, lateral pressure P is applied to receptacle walls adjacent to the dividing wall.

In both Truhan and Baumann, the seal separating the chambers has score lines which are formed from the removal of material from the seal itself. The removal of material is necessary to sufficiently weaken the seal structure to facilitate rupture. However, the removal of material compromises the burst strength of the seal and can lead to inconsistent and untimely seal rupture. As a result, the effectiveness of both the seal and the device is reduced. In addition, providing score lines on the seal requires an additional, separate manufacturing step.

Furthermore, with both devices it is necessary to under fill the container with liquid leaving ample air space. This under filling increases the chance of accidental seal rupture from pressure on the container. Consequently, the volume of liquid stored within the chamber must be reduced.

Additionally, the dispensers disclosed in Truhan and Baumann are designed to release the entire fluid contents at one time. Thus, the user cannot control the distribution and application of the liquid over a period of time.

Finally, the dispensers disclosed in Truhan and Baumann are of a single chamber design, capable of storing and dispensing only one flowable material. Thus, the dispenser cannot contain a plurality of fluids which can be mixed by the user at a desired time, and then dispense the mixture.

The present invention is provided to solve these and other problems.

SUMMARY OF THE INVENTION

The present invention provides a dispenser for discharging either a flowable liquid or solid material, or mixture of materials. To this end, there is a device provided having three adjacent chambers separated from each other by a pair of novel rupturable webs or fracturable membranes. The first chamber has a distal end and is a storage chamber for a first flowable material. The second chamber is adjacent to the first chamber, and is a storage chamber for a second flowable material. The third chamber is adjacent the second chamber, and has a proximate end and receives the mixture of the first and second flowable materials when released from the first and second chambers by rupture of the second membrane. The first, second and third chambers are defined by a peripheral wall with an elongated axis forming a sleeve or cylinder. After the first material is added to the first chamber, the distal end, the end opposite from the membrane, is sealed to hold the material in the first chamber. The first chamber can be closed off or sealed by pressing the sides of the end of the chamber together and heat sealing or applying an adhesive. Alternatively, the first chamber can be sealed by applying a cap over the end of the tube. The membrane separating the chambers is provided with a weld seam and is broken by lateral force on the membrane to allow the fluid to flow from the first chamber into the second chamber. The thickness of the membrane and/or weld seam structure can be varied, thereby either increasing or decreasing the amount of applied force needed to rupture the membrane.

According to one aspect of the invention, the dispenser may include an optional applicator in communication with the third chamber. The applicator can be any variety of applicators well known in the art, including swabs, nozzles, sponges, and droppers. These applicators can also be protected by an optional cover.

In accordance with the invention, the membrane is preferably disk-shaped having a series of radial disposed weld seams on one surface of the disk and extending from a center point of the disk in the form, for example, of spokes on a wheel. The thickness of the membrane is lesser at the weld seams. When the membrane is compressed by exerting pressure on the edge of the membrane, the membrane breaks along the weld seams forming a series of web segments extending from the face of the membrane. Since the web segments are widest where they contact the container wall, the center section of the membrane preferably opens first to allow material to flow. The amount of material that can pass into the second chamber is controlled by the degree of opening which corresponds to the weld seams and the pressure applied to the chamber. The web segments formed as a result of the compression will extend in the direction of the flow of the material. This arrangement permits an even flow of the material.

According to another aspect of the invention, the novel membrane has opposing first and second surfaces. The membrane is formed by a first segment of injected molded material that abuts a second segment of injected molded material to form the weld seam. The membrane thickness is reduced at the weld seams. In one preferred embodiment, the weld seam comprises a plurality of weld seams that are generally pie-shaped and are molded at right angles to the interior surface of the dispenser. The web segments are widest at their base where they extend from the interior dispenser surface and narrow as they radially extend toward a center portion of the membrane. Under normal use and operation, the membrane partitioning the first and second chambers can only be ruptured by the precise administration of force on the membrane. The membrane will not rupture when the first chamber is compressed by normal hand pressure. Conversely, extreme force loads are required to rupture the membrane by compressing the first chamber. Such forces would not be present during normal use and handling of the dispenser.

When the membrane is compressed by exerting pressure proximate the edge of the membrane, the membrane ruptures only along the weld seams. Unlike prior art devices, the membrane rupture is predictable and controlled at the weld seams. The amount of material which can pass into the second chamber is controlled by the degree of membrane opening which is directly controlled by the amount of force applied to the membrane by the user.

According to another aspect of the invention, the outer surface of the chamber walls can be provided with indicators to indicate the preferred locations where force should be applied to rupture the membranes. In one preferred embodiment, one indicator is an external extension, while the second indicator is a circumferential ring on the peripheral wall of the container. Such an extension can be in the form of a thumb pad, which corresponds to the location where force should be applied. Alternately, the outer surface of the chamber can have any type of raised area or projection such as a circular band around the outside of the chamber to indicate the desired point of force application. The outer surface could also have an indicia or other marking to indicate where force should preferably be applied.

In accordance with the invention, the first and second chambers are preferably of one piece construction, while the third chamber is a separate piece which is connected to the second chamber after the second chamber has been filled with the second flowable material. The third chamber includes a projection which is friction fit into the second chamber. This preferred construction provides a mechanism for easy filling of the second chamber. The first flowable material to be utilized can be fed into the first chamber through the distal end, and the end of the chamber sealed. Because the release of the material depends on the application of pressure to the web to break the weld seams, and not the pressure of the material fluid against the web, it allows the chamber to be filled with small quantities of material. If the seal is to be broken by the pressure of liquid material as in the prior art devices, sufficient liquid has to be present to create the required hydraulic pressure when compressed. Further, the dispenser of the invention allows the dispensing of non-liquids such as a powder which would not exert any hydraulic pressure.

According to yet another aspect of the invention, the dispenser comprises a first and second container wherein the first container is slidably mounted inside of the second container. The first container houses a first and second chamber and a pair of membranes while the second container houses a third chamber. An applicator is mounted to a cover on the proximate end of the third chamber, with a portion of the applicator extending through the second membrane into the second chamber. During use of the dispenser, the container is axially squeezed such that the applicator pierces the first membrane allowing mixing of the first and second flowable materials. The cap is then removed, thereby removing the applicator from the container. The applicator, having been saturated in the mixture, is then used to apply the mixture to a surface.

According to yet another aspect of the invention, the dispenser has a first and second chamber, and at least one membrane between the chambers. The first chamber contains a flowable material which is filled into the chamber through a distal end of the first chamber, which is then sealed. The second chamber has a proximate end which is sealed by an applicator, which is preferably a sponge cooperatively dimensioned with the proximate end of the second chamber. During use, a squeezing force is applied to the sides of the first chamber, thereby rupturing the membrane and allowing the flowable material to flow through the membrane and into the second chamber where it saturates the applicator. Once the material propagates from an interior surface of the applicator to an exterior surface of the applicator, a user may apply the flowable material to a surface by contacting the surface with the saturated exterior surface of the applicator.

According to another aspect of the invention, the dispenser has a container having an open end and a closure member having a membrane having a weld seam. The closure member is sealed to the open end of the container. In one preferred embodiment, the container is an extruded tube and the closure member is an injection-molded member.

Other features and advantages of the invention will be apparent from the following specification taken in conjunction with the following drawings.

BRIEF DESCRIPTION OF THE DRAWINGS

FIG. 15 is a perspective view of a third preferred embodiment of the dispenser;

FIG. 16 is a cross-sectional view of a membrane of the dispenser of FIG. 15, taken along lines 16-16;

FIG. 17 is a top view of the dispenser of FIG. 15;

FIG. 18 is a cross-sectional view of the dispenser of FIG. 17, taken along lines 18-18;

FIG. 19 is a cross-sectional view of the dispenser of FIG. 18, taken along lines 19-19;

FIG. 20 is a cross-sectional view of the dispenser of FIG. 19, showing the flowable material traveling from a first chamber through the ruptured membrane, and into a second chamber;

FIG. 22 is an exploded view of a two piece embodiment of a dispenser according to the present invention;

FIG. 23 is a perspective view of the dispenser of FIG. 22;

FIG. 24 is a partial side elevation view of the dispenser of FIG. 22;

FIG. 25 is a side elevation view of yet an alternative embodiment of a two piece dispenser showing a partial cross section thereof;

FIG. 26 is a side elevation view of yet an alternative embodiment of a two piece dispenser according to the present invention showing a partial cross section thereof;

DETAILED DESCRIPTION

Figures 1, 2, 3, 4:
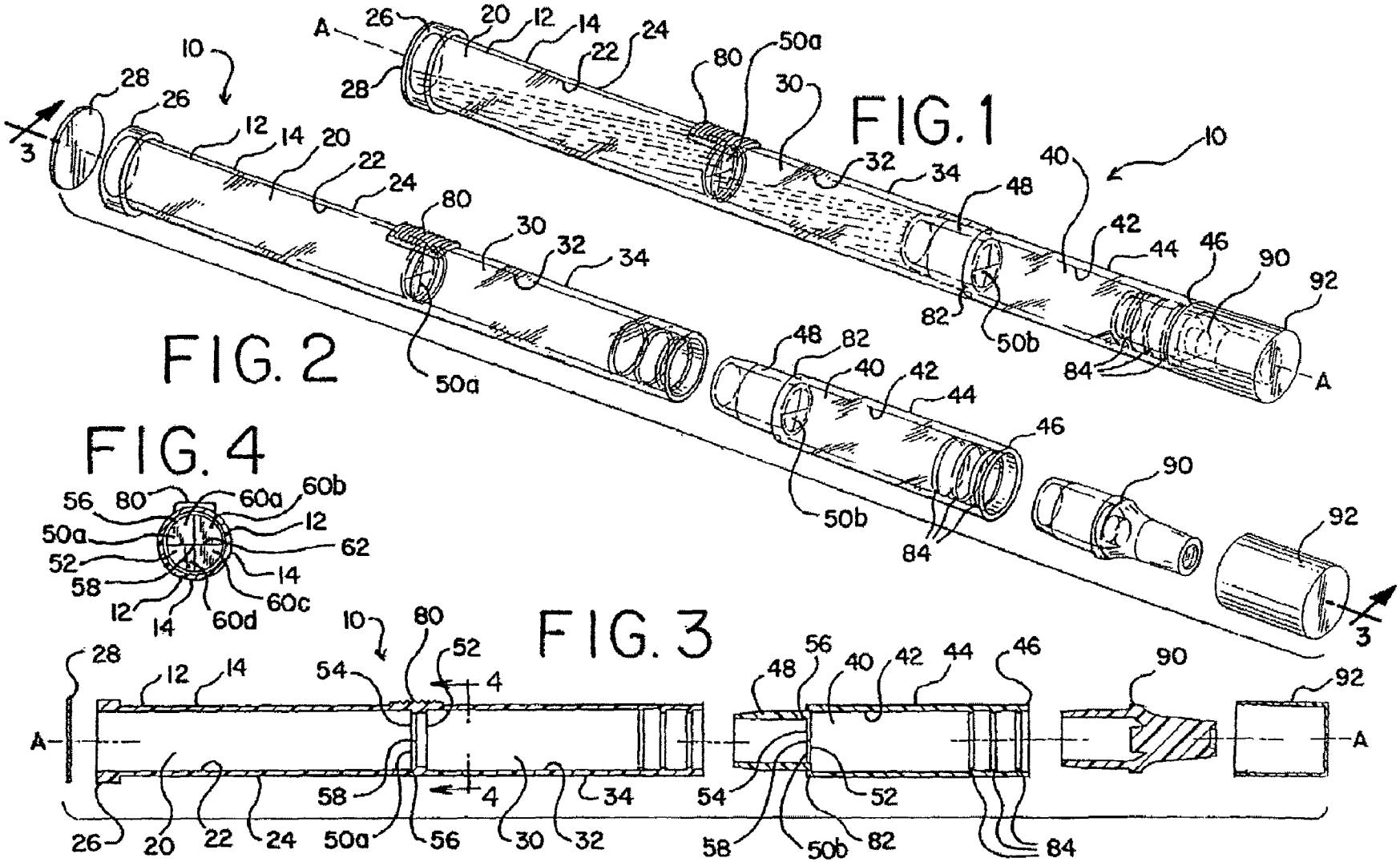
FIG. 1 is a perspective view of a dispenser of the present invention.
FIG. 2 is an exploded perspective view of the dispenser of FIG. 1.
FIG. 3 is an exploded cross-sectional view of the dispenser of FIG. 2, taken along lines 3-3 in FIG. 2.
FIG. 4 is a cross-sectional view of the container of the dispenser of FIG. 3, taken along lines 4-4, showing a membrane.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

As seen in FIGS. 1-9, the present invention relates to a dispenser generally designated by the reference numeral 10. The dispenser 10 generally comprises a container 12 having a peripheral wall 14, and has one sealed end 16 and one open end 18, as will be described in further detail below. As shown in FIG. 1, the container 12 has an elongated axis A-A along its length. In one preferred embodiment, the container 12 is cylindrical and generally forms a sleeve, however, it is understood that the container 12 can take on a variety of other shapes.

Referring now to FIG. 2, the container 12 of the dispenser 10 is divided into three chambers 20, 30, 40. In the preferred embodiment, the container 12 includes a first portion 8, defining the first and second chamber 20,30, and a second portion 9, defining the third chamber 40. Each chamber 20,30,40 is separated from an adjacent chamber 20,30,40 by a membrane or web 50, described in greater detail below. The first chamber 20 is nearest the sealed end 16 of the container 12, while the third chamber 40 is nearest the open end 18 of the container 12. The second chamber 30 is positioned between the first chamber 20 and the third chamber 40. While this preferred embodiment has three chambers 20,30,40, it is understood that more or less chambers can be defined within the container 12. The first and second chambers 20,30 are separated by a first membrane 50*a*, while the second and third chambers 30,40 are separated by a second membrane 50*b*, described in greater detail below.

Referring now to FIGS. 1-4, and in reference to the first portion 8 of the container 12, the first chamber 20 has an interior surface 22, an exterior surface 24, and a distal end 26. Preferably the distal end 26 of the first chamber 20 is formed by the sealed end 16 of the container 12. The distal end 26 of the first chamber 20 can be closed by a number of sealing methods, including heat or adhesive sealing. Alternatively, the distal end 26 can receive a cap 28 to close the first chamber 20. Therefore, the first chamber 20 is formed, or defined, by the cooperation of the interior surface 22, the distal end 26, and the first membrane 50*a*. The first chamber 20 is adapted to receive and contain a first flowable material 4. The second chamber 30 has an interior surface 32 and an exterior surface 34. Thus, the second chamber 30 is formed, or defined, by the cooperation of the interior surface 32 and the two membranes 50*a,b*. The second chamber 30 is adapted to receive and contain a second flowable material 5. Also, the third chamber 40 has an interior surface 42, an exterior surface 44, a proximate end 46, and a protrusion 48. Preferably the proximate end 46 of the third chamber 40 is formed by the open end 18 of the container 12. The protrusion 48 is friction-fit inside the second chamber so to connect the third chamber 40 with the remainder of the container 12. Thus, the third chamber 40 is formed, or defined, by the interior surface 42 in cooperation with the second membrane 50*b* and the open end 18 of the container 12. Furthermore, in this preferred embodiment, the exterior surfaces 24,34,44 of the chambers 20,30,40 are formed by the peripheral wall 14 of the container 12, however, it is understood that the chambers 20,30,40 may be positioned entirely within the containers in a manner such that the peripheral wall 14 of the container 12 would be independent of the exterior walls 24,34,44 of the chambers 20,30,40.

Preferably, the first and second chambers 20,30 are of a one-piece construction defined by the first portion 8 of the container 12, while the third chamber 40 is a separate piece defined by the second portion 9 of the container 12, as seen in FIG. 2. This construction facilitates the filling of the flowable materials 4,5 into the first and second chambers 20,30. The first chamber 20 is filled through the distal end 26 prior to it being sealed, while the second chamber 30 is filled prior to the mating of the protrusion 48 of the second portion 9 with the first portion 8.

As stated, the chambers 20,30,40 are divided and separated by two membranes or webs 50*a*, 50*b*, best seen in FIGS. 1-4. Each membrane 50*a*, 50*b* is preferably constructed in a circular configuration, in the shape of a disk. However, a large variety of configurations would be acceptable for the membranes 50*a*, 50*b*. Each membrane 50*a*, 50*b* is a flat plastic sheet having a first surface 52 and a generally opposite second surface 54. Given the circular configuration, each membrane

50*a*, 50*b* also has an outer edge 56 and a center point 58. On the first surface 52 of each membrane 50*a*, 50*b* a series of weld seams 62 extend substantially from the center point 58 to the outer edge 56. In this preferred embodiment, four weld seams 62 extend from the center point 58 in the form of spokes of a wheel, however, a large variety of arrangements of weld seams 62 can be utilized, including fewer or more weld seams 62. Compression of the container 12, such as by finger pressure, causes the membranes 50*a*, 50*b* to break, or rupture, only along the weld seams 60*a,b,c,d* thereby dividing the membrane 50*a,b*, into a series of web segments 60*a,b,c,d*, which are displaced in overlapping fashion (FIG. 4B) to create a web opening 64 in the membrane 50*a,b*. The web opening 64 in the ruptured first membrane 50*a* permit the release of the first flowable material 4 from the first chamber 20 to the second chamber 30, and also permits the release of the second flowable material 5 from the second chamber 30 to the first chamber 20. Stated differently, rupture of the first membrane 50*a* allows mixing of the first and second flowable materials 4,5 through the web opening 64 to form a mixture 6 collectively contained within the first and second chambers 20,30.

Figure 4A:
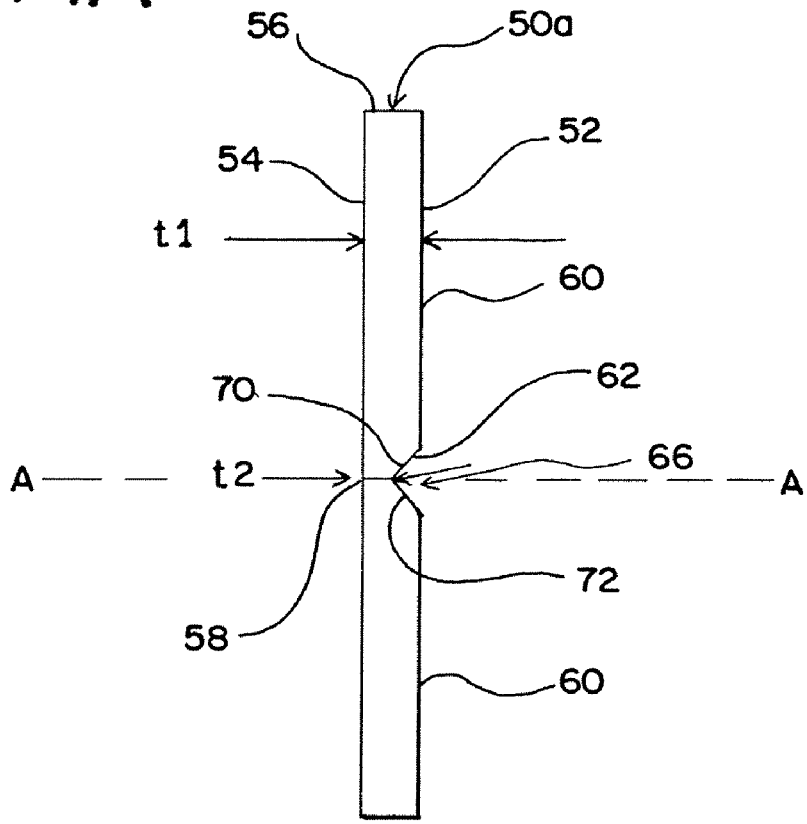
FIG. 4A is a side view of the membrane of the dispenser of the present invention.
Figure 4B:
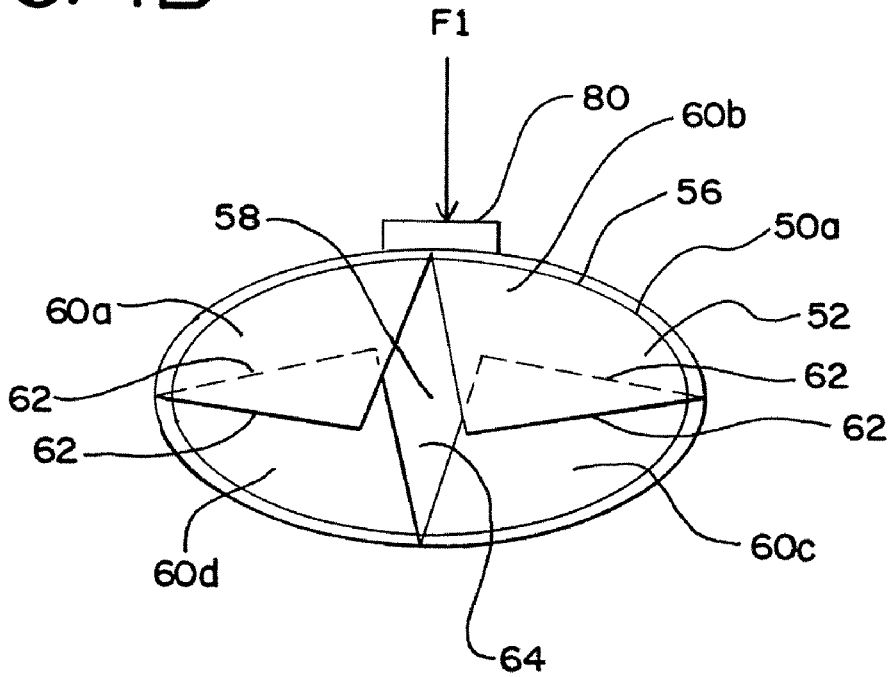
FIG. 4B is an end view of the membrane of FIG. 4, shown in the compressed or ruptured position.

Referring to FIGS. 4-4B, it is seen that since the web segments 60*a,b,c,d* are "pie-shaped" and widest at the outer edge 56 of the membrane 50*a*, the center section of the membrane 50*a* breaks open the widest. The amount of flowable materials that can be delivered through the membrane 50*a* is controlled by the size, or degree, of the web opening 64. Also, it can be seen that the size of the web opening 64 is controlled by the configuration of the weld seams 62 and the degree of pressure of the fingers of the user pressing on the container 12 to assert pressure on and distort the shape of the membrane 50*a*.

As shown in FIG. 4A, each membrane 50*a,b* has the first surface 52 and the second surface 54. The first surface 52 of the first membrane 50*a* faces towards the first chamber 20, while the second surface 54 of the first membrane 50*a* faces towards with the second chamber 30. Similarly, the first surface 52 of the second membrane 50*b* faces towards the second chamber 30, while the second surface 54 of the second membrane 50*b* faces towards the third chamber 40. On each membrane 50*a,b*, the second surface 54 is substantially planar, while the first surface 52 has a plurality of weld seams 62 thereon. In this preferred embodiment, each membrane 50*a,b* is disposed substantially transverse to the elongated axis A-A of the container 12. Each membrane 50*a,b*, further has a base thickness "t1" between the first surface 52 and the second surface 54, which is generally referred to as the membrane thickness. Each weld seam 62 has a thickness "t2" that is less than the membrane thickness t1. This facilitates the rupture of the weld seam 62 during the use of the dispenser 10, as will be described in greater detail below.

As shown in FIGS. 1-4, each membrane 50*a,b* preferably contains a plurality of weld seams 62, which can be arranged in a number of configurations including but not limited to a cross, star, or asterisk. It is understood, however, that the benefits of the invention can be realized with a single weld seam 62 formed from a pair of web segments 60*a,b* abutting one another. In a preferred embodiment, the weld seams 62 are arranged in a cross configuration wherein the membrane 50*a,b* has a pie-shape. As seen in FIGS. 4C-4H. adjacent web segments 60*a,b* abut with one another to form the weld seams 62. As further shown in FIG. 4, the plurality of weld seams 62 extend radially from substantially a center point 58 on the membrane 50*a,b* completely to an outer edge 56 of the membrane 50*a,b* and to the interior surface of the container 12. It is understood, however, that the weld seams 62 do not need to extend to the outer edge 56 of each membrane 50*a,b*. In a most preferred embodiment, the membrane 50*a,b* has four web segments 60*a,b,c,d* wherein adjacent web segments 60*a,b,c,d* abut at four separate interface areas to form four weld seams 62*a,b,c,d*. Explained somewhat differently, the first surface 52 of each membrane 50*a,b* has a plurality of channels 66 formed therein. The weld seams 62 confront the channels 66. The channels 66 are formed by a first wall 70 adjoining a second wall 72. In a preferred embodiment, the first wall 70 adjoins the second wall 72 at substantially a 90 degree angle. Acute angles or obtuse angles are also possible. Thus, in one preferred embodiment, the channels 66 are V-shaped, as seen in FIG. 4A.

Figure 4C:
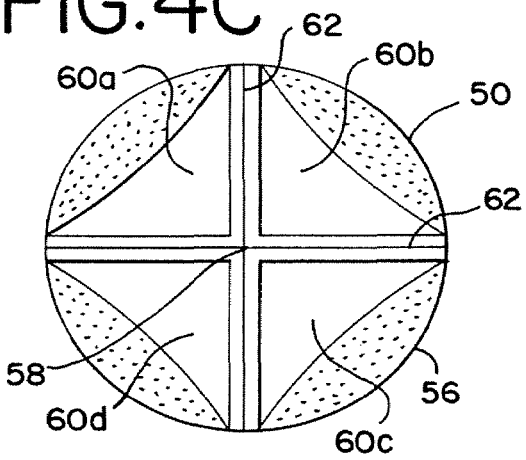
FIGS. 4C through 4H are a series of views showing the injection molding process of the membrane wherein adjacent web segments abut to form weld seams.
Figure 4F:
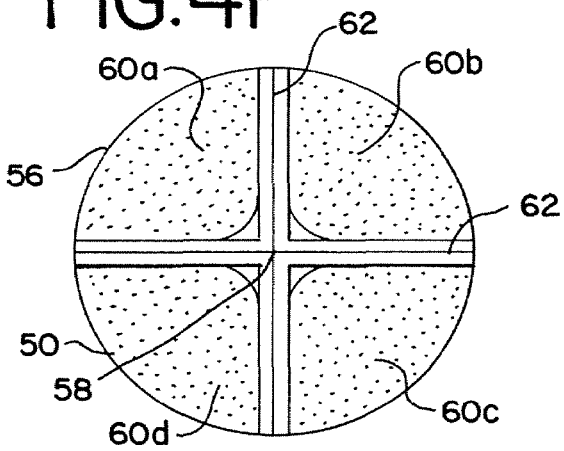
Figure 4D:
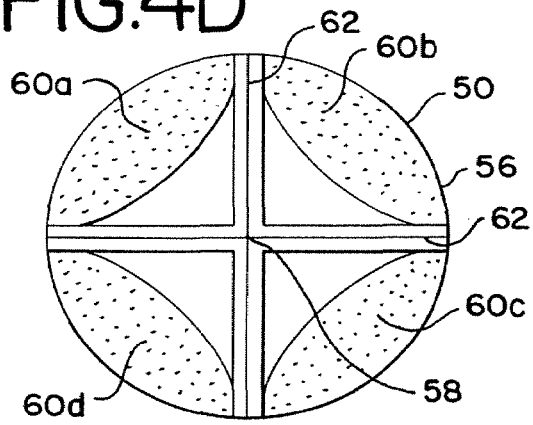
Figure 4G:
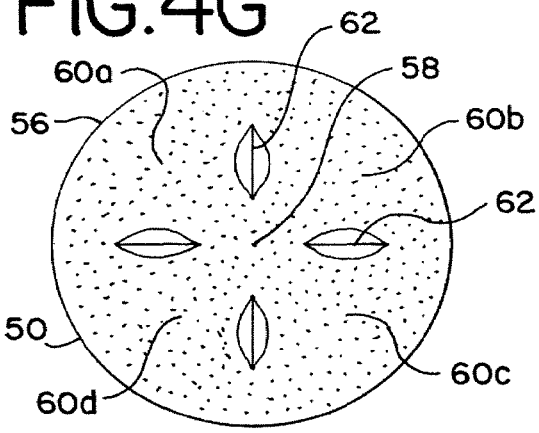
Figure 4E:
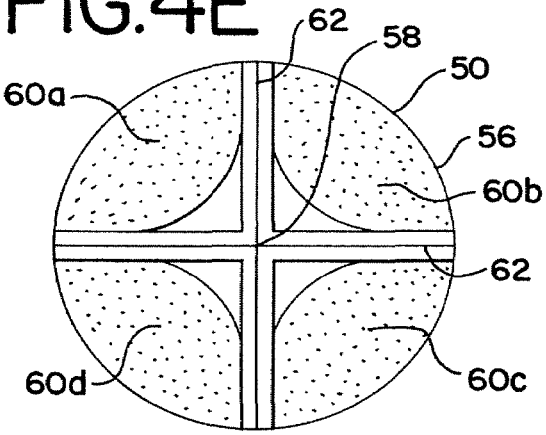
Figure 4H:
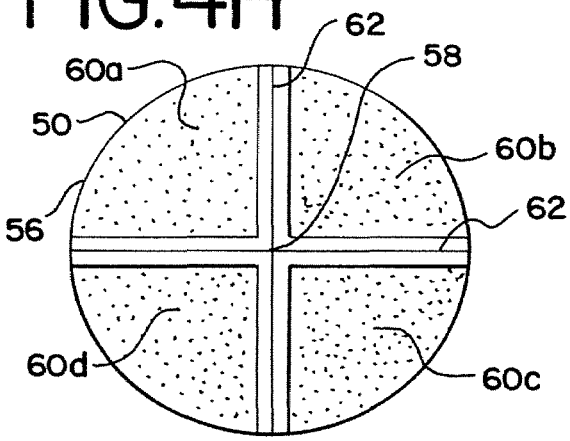
Figure 5:
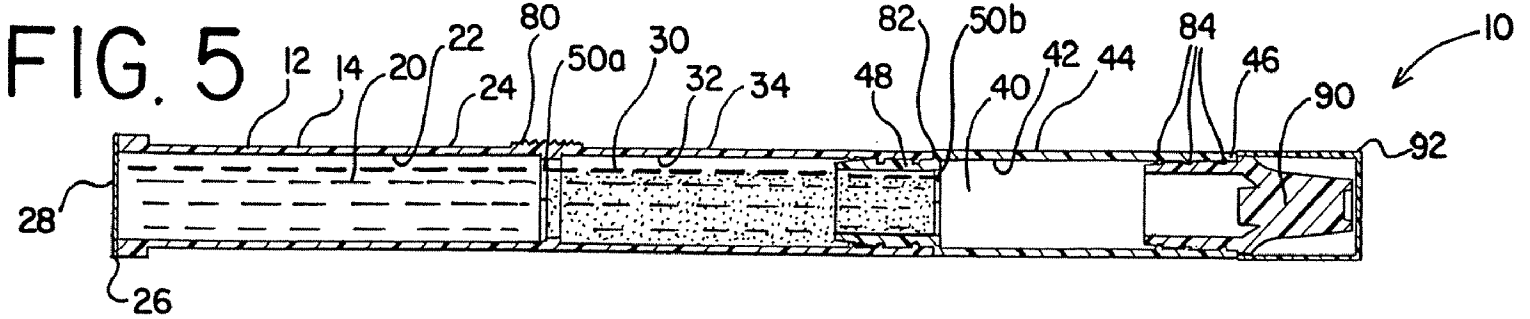
FIG. 5 is a cross-sectional view of the dispenser of FIG. 3 showing the first and second chambers filled with a first and second flowable material, respectively.

In a preferred embodiment, the membranes 50*a,b* are formed within respective portions 8,9 of the container 12 through an injection molded process depicted in FIGS. 4C-4H. Specifically, molten thermoplastic material is injected into a mold cavity such that the material flows first from an outer edge 56 of the mold cavity, as seen in FIG. 4C, towards the center point 58 of the membrane 50 (FIGS. 4D-4F), and into adjacent web segments 60*a,b,c,d* to form the weld seams 62 (FIGS. 4G and 4H). This injection molding process is described in greater detail in U.S. Pat. No. 6,641,319 which is incorporated by reference and made a part hereof. In a preferred embodiment, the first membrane 50*a* is located on the first portion 8 of the container 12 while the second membrane 50*b* is located on the second portion 9 of the container 12, however, other configurations are possible. Furthermore, although the above described injection molding process is preferred, membranes 50*a,b* can also have other fracturable or rupturable structures, such as score lines or depressions.

The container 12 also has a pair of exterior indicators 80,82 connected to the peripheral wall 14 of the container 12. Each indicator 80,82 indicates the location where force should be applied in order to rupture the first and second membranes 50*a,b* respectively. Specifically, the first indicator 80 is located directly adjacent to the first membrane 50*a*, while the second indicator 82 is located directly adjacent the second membrane 50*b*. In this preferred embodiment, the first indicator 80 is shown as a thumbpad, while the second indicator 82 is a circumferential marking about the peripheral wall 16 of the container 12. It should be recognized, however, that any type of raised area or projection will suffice to act as a indicator 80,82, including a button, prong, or ring. In addition, a ring of material, or other visual indicator, could be applied to the container 12 corresponding to the location of each membrane 50*a,b* so that a user would know precisely where to apply finger pressure. In short, any indicia-bearing marking would be sufficient.

As shown in FIGS. 2 and 3, the third chamber 40 has a plurality of circumferential ribs 84 on the interior surface of the third chamber 40. These ribs 84 are preferably located near the proximate end 46 of third chamber 40, and can be of varying thicknesses and lengths. The ribs 84 extend away from the interior surface 42 of the third chamber 40, and radially inward towards the longitudinal axis A-A of the container 12. The ribs 84 secure a variety of applicators 90, such as a swab, a dropper, or a nozzle (as seen in FIGS. 1-3), which can be used to apply the dispensed mixture of materials from the container 12. The applicator 90 can also be optionally covered by a cover 92, as seen in FIG. 2. The applicator 90, which in one preferred embodiment is a nozzle, forms an interference fit with the ribs 84. The applicator 90 could also take other forms such as a luer lock.

In a preferred embodiment, the dispenser 10 is made of a transparent, flexible thermoplastic material. The preferred plastic material is polyethylene or polypropylene but a number of other plastic materials can be used. For example, low-density polyethylene, polyvinyl chloride or nylon copolymers can be used. In a preferred embodiment, a mixture of polypropylene and polyethylene copolymer or thermoplastic olefin elastomer is used. In another preferred embodiment, a mixture of polypropylene and Flexomer®, is utilized. It is essential that the dispenser be made of material which is flexible enough to allow sufficient force to rupture the membranes 50*a,b*.

The following description is directed at the formation, use and operation of the dispenser 10. As discussed, each portion 8,9 and component is fabricated such as by appropriate injection-molded processes. The first portion 18 of the dispenser 10 is first filled with a first flowable material 4 in the first chamber 20, and a second flowable material 5 in the second chamber 30. The first flowable material 4 is sealed into the first chamber 20 by the sealing of the distal end 26 with the cap 28. The second flowable material 5 is sealed into the second chamber 20 by the mating of the protrusion 48 of the second portion 9 with the first portion 8 to connection the portions 8,9. Thus, with the two portions 8,9 of the container 12 connected, containing the first and second materials 4,5 in the first and second chambers 20,30 respectively, the dispenser 10 is ready for use. It is understood that the portions 8,9 can be connected in various known ways. It is noted that additional second portions 9 may be incorporated in the instance that more than two flowable materials are desired to be mixed and/or applied. For instance, two second portions 9 (see FIG. 2) may be utilized between the first portion 8 and the applicator 9 to create additional chambers. In fact, a plurality of second portions 9 may be utilized to create a plurality of chambers.

Figure 6:
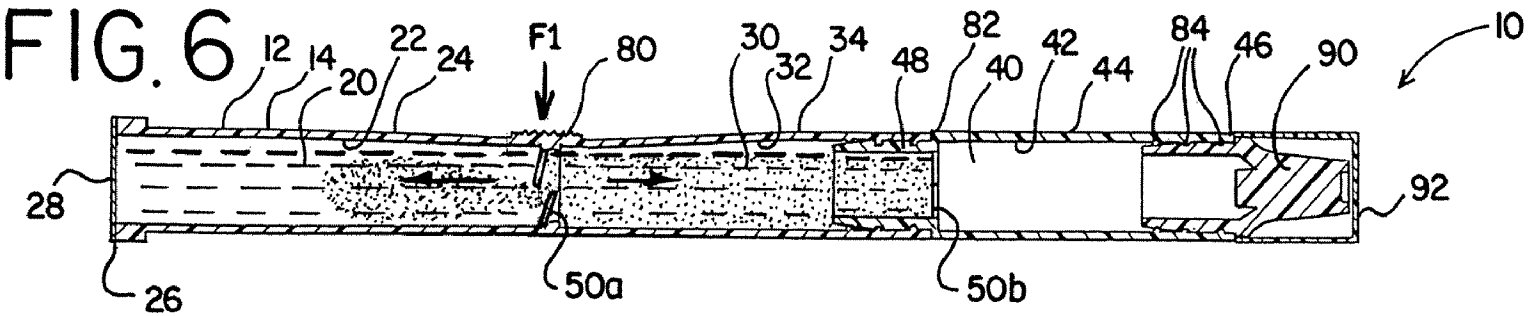
FIG. 6 is a cross-sectional view of the dispenser of FIG. 5 showing a ruptured first membrane allowing mixing of the flowable materials.

As shown in FIG. 6, a user first applies a selective force F1 on the container 12 at the first exterior extension 80 adjacent to the first membrane 50*a*. When sufficient force is applied, lateral pressure on the membrane 50*a* causes it to shear and rupture along the weld seams 62. The first membrane 50*a* ruptures only along the weld seams 62*a,b,c,d* to create a web opening 64. Upon rupture of the first membrane 50*a*, the first flowable material 4 passes through the web opening 64 (FIGS. 4B and 6) from the first chamber 20 to the second chamber 30, where the first and second flowable materials 4,5 are mixed to form a mixture 6. As seen in FIG. 4B, the flow rate of the first flowable material 4 through the first membrane 50*a* is controlled by the degree of the web opening 64 which is related to the amount of force F1 applied to the membrane 50*a* by the user. Therefore, the user can regulate the flow of the first material 4 after rupture of the membrane 50*a*. In addition, the membrane 50*a* can preferably have elastic characteristics such that when the force F1 is removed, the membrane 50*a* returns substantially to its original position, as seen in FIG. 4. While the weld seams 62*a,b,c,d* may be ruptured, the web segments 60*a,b,c,d* can form a close enough fit to prevent material 4 from flowing past the first membrane 50*a* without additional pressure on the membrane 50*a*. Thus, the membrane 50*a* can act as a check valve to prevent unwanted discharge of the first flowable material 4 from the first chamber 20.

Figure 7:
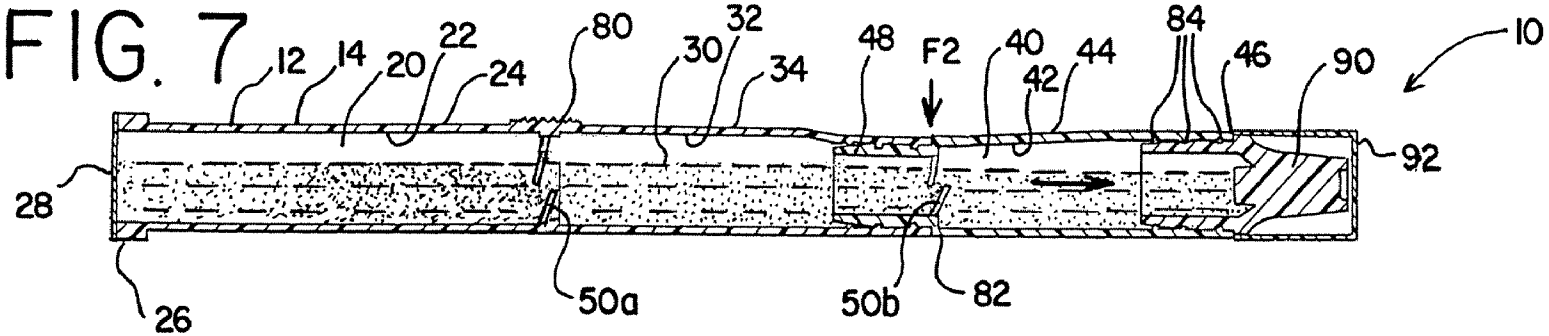
FIG. 7 is a cross-sectional view of the dispenser of FIG. 6 showing a ruptured second membrane allowing dispensing of the mixture through the third chamber.
Figure 8:
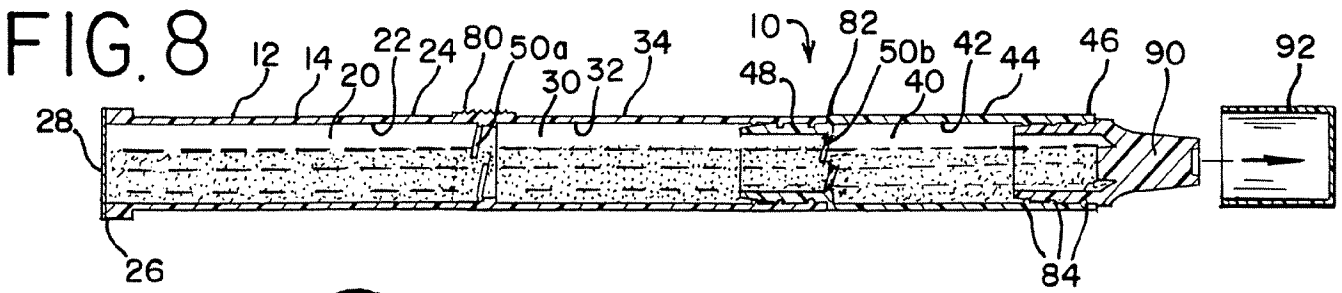
FIG. 8 is a cross-sectional view of the dispenser of FIG. 7 showing an applicator cover removed allowing dispensing of the mixture through the applicator.
Figure 9:
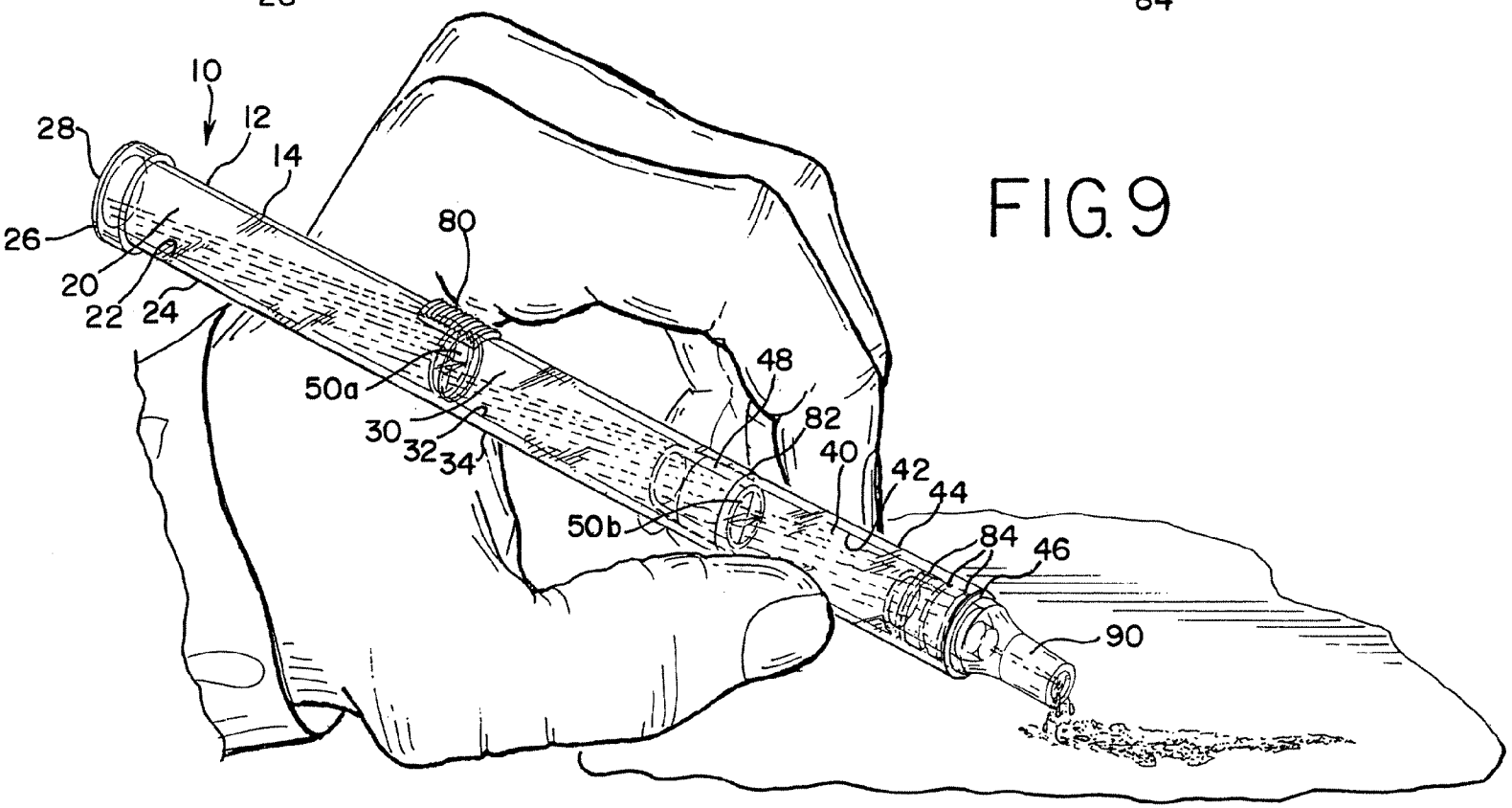
FIG. 9 is a perspective view of the dispenser of FIG. 8 showing the dispenser in use by an operator.

As seen in FIG. 7, following the mixture of the first and second flowable materials 4,5, the user can the apply a second selective force F2 to the second exterior extension 82 adjacent the second membrane 50*b*. When sufficient force is applied, lateral pressure on the membrane 50*b* causes it to shear and rupture along the weld seams 62. The membrane 50*b* ruptures only along the weld seams 62 to create a web opening 64. Upon rupture of the second membrane 50*b*, the mixture 6 of the first and second flowable materials 4,5 passes through the web opening 64 from the second chamber 30 to the third chamber 40, where the mixture 6 can be dispensed from the dispenser 10, either with or without the use of an applicator 90 connected to the third chamber 40. The flow rate of the mixture 6 through the second membrane 50*b* is controlled by the degree of the web opening 64 which is related to the amount of force F2 applied to the membrane 50*b* by the user. Therefore, the user can regulate the flow of the mixture 6 after rupture of the second membrane 50*b*. In addition, the membrane 50*b* can preferably have elastic characteristics such that when the force F2 is removed, the membrane 50*b* returns substantially to its original position. (For clarity purposes, the membranes 50*a*, 50*b* are shown with segments spaced apart after rupture.) While the weld seams 62 may be ruptured, the web segments 60*a,b,c,d* can form a close enough fit to prevent the mixture 6 from flowing past the second membrane 50*b* without additional pressure on the membrane 50*b*. Thus, the second membrane 50*b* can act as a check valve to prevent unwanted discharge of the mixture 6 from the first and second chambers 20,30. It is understood that although the preferred embodiment of the dispenser 10 contains two flowable materials 4,5 in two chambers 20,30, a larger number of chambers can be utilized without departing from the spirit of the present invention. For example, the container 12 could have four chambers which house four flowable materials to be mixed, each chamber separated by a similar membrane 50.

It is understood that the locations of the first and second membranes 50*a,b* can be altered, thereby altering the size and shape of the three chambers 20,30,40 and also the two portions 8,9 of the container 12. It is understood that the locations of the membranes 50*a,b* affects the dimensions and configurations of the chambers 20,30,40. Additionally, it should also be understood that the third chamber 40 of the dispenser 10 is optional, and not required. The dispenser 10 only requires the first and second chambers 20,30 divided by the first and second membranes 50*a,b*. In this configuration, the second membrane 50*b* is located at the proximate end 46 of the second chamber 40. Alternatively, the second membrane 50*b* is optional as well, and could be omitted. In this configuration, the applicator 90 can be connected in place of the second membrane 50*b* to the proximate end 46 of the second chamber 40.

Figure 10:
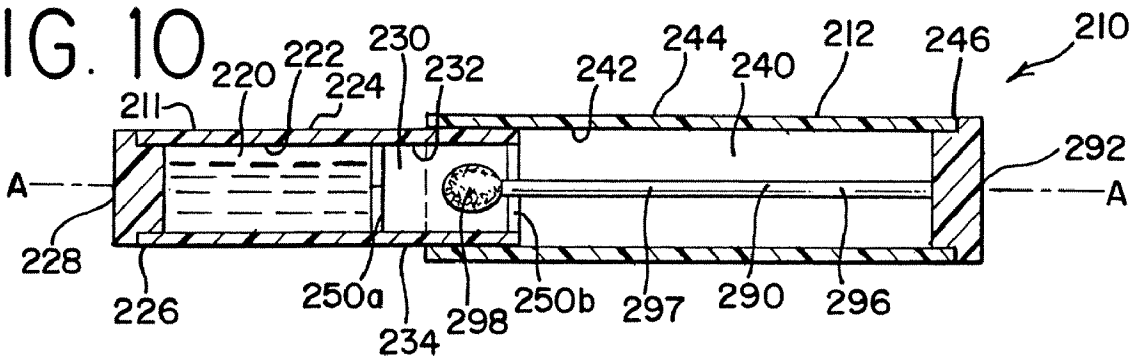
FIG. 10 is a cross-sectional view of a second preferred embodiment of the dispenser.

A second preferred embodiment of the dispenser is shown in FIGS. 10-14, generally referred to by reference numeral 210. Like elements will be referred to with similar reference numerals. As seen in FIG. 10, the second preferred embodiment of the dispenser 210 comprises a first container 211 having a first chamber 220 and a second chamber 230, and a second container 212 having a third chamber 240. The dispenser 210 also has a pair of membranes, or webs, 250*a,b*, and an applicator 290.

Referring now to FIGS. 10-14, the first container 211 has two chambers 220,230. The first chamber 220 has an interior surface 222, an exterior surface 224, and a distal end 226. The distal end 226 of the first chamber 220 can be closed by a number of sealing methods, including heat or adhesive sealing. Alternatively, the distal end 226 can receive a cap 228 to close the first chamber 220. Therefore, the first chamber 220 is formed, or defined, by the cooperation of the interior surface 222, the distal end 226, and the first membrane 250*a*. The first chamber 220 is adapted to receive and contain a first flowable material 204. The second chamber 230 has an interior surface 232 and an exterior surface 234. Thus, the second chamber 230 is formed, or defined, by the cooperation of the interior surface 232 and the two membranes 250*a,b*. Preferably, the first container 211 housing the first and second chambers 220,230 is of a one-piece construction The first and second chambers 220,230 are divided and separated by a first membrane 250*a*, best seen in FIG. 10. Furthermore, the second chamber 230 is terminated by a second membrane 250*b*. The first and second membranes 250*a*, 250*b* are constructed the same as in the dispenser 10 of the first preferred embodiment above.

Figure 11:
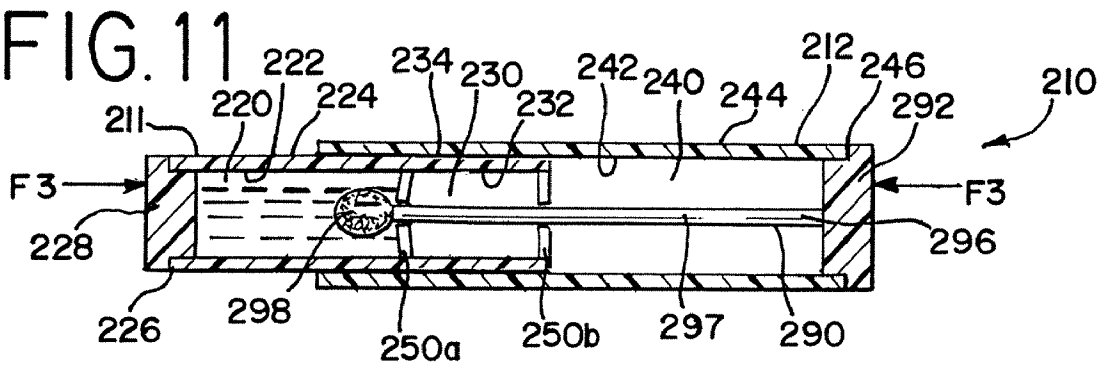
FIG. 11 is a cross-sectional view of the dispenser of FIG. 10 showing an applicator piercing a first membrane.

The dispenser 210 also comprises a second container 212 housing a third chamber 240. The third chamber 240 has an interior surface 242, an exterior surface 244 and a proximate end 246. Preferably the proximate end 246 of the third chamber 240 is formed by a removable cover 292 in the container 212. Thus, the third chamber 240 is formed, or defined, by the interior surface 242 in cooperation with the second membrane 250*b* and the cover 292 at the proximate end 242. Mounted within the third chamber 240 is an applicator 290, which is preferably a swab 296. The swab 296 includes a stem 297 and a head 298, as seen in FIG. 10. The stem 297 of the swab 296 is connected to the cover 292 at the proximate end 246 of the third chamber 240, as seen in FIG. 11. The head 298 of the swab 296 is originally positioned within the second chamber 230. Thus, the stem 298 of the swab 296 extends through the second membrane 250*b*, as seen in FIG. 10. It is understood that the applicator 290 can take many different forms, including a brush, a dropper, or a nozzle.

The first container 211 is slidably mounted within the second container 212, as seen in FIGS. 10 and 11. Stated differently, the first and second chamber 220,230 slide axially within the third chamber 240. Thus, the exterior surface 234 of the second chamber 230 creates an interference fit with the interior surface 242 of the third chamber 240, but yet allows the chambers 230,240 to slide axially relative to one another.

Figure 12:
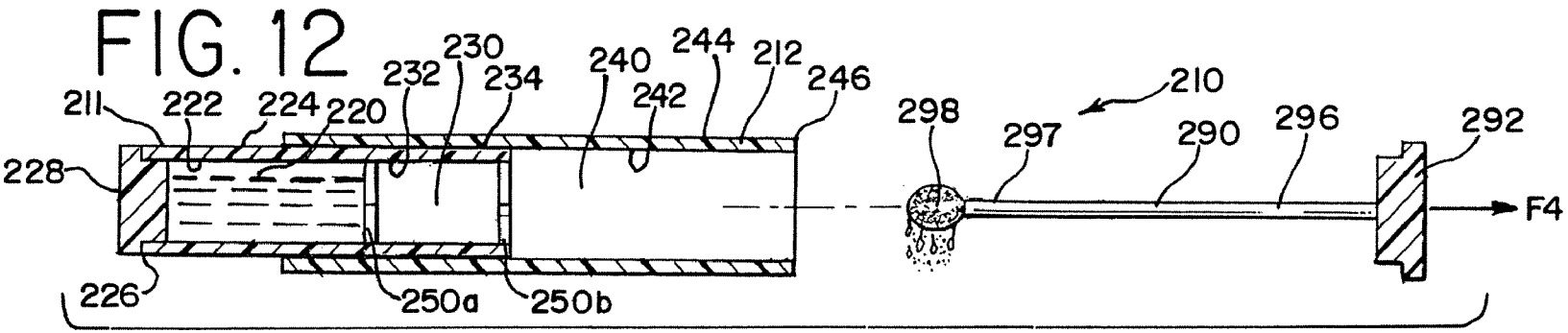
FIG. 12 is a cross-sectional view of the dispenser of FIG. 11 showing the cover and applicator removed from the container of the dispenser.

This second preferred embodiment of the dispenser 210 is preferably used to dispense only one flowable material 204, as shown in FIG. 12. The material 204 is filled into the first chamber 220, and the chamber 220 is sealed at the distal end 226. The third chamber 240 is mated with the second chamber 230 such that a portion of the applicator 290 is positioned within the second chamber 230, as seen in FIG. 10. Thus, the head 298 of the swab 296 is positioned in the second chamber 230, and the stem 297 passing through the second membrane 250*b* and into the third chamber 240 where the stem 297 is secured to cover 292 in the third chamber 240.

When the dispenser 210 is to be used, the first membrane 250*a* must be ruptured or fractured. This is accomplished through the application of a crushing force F3 on the exterior surface 224 of the first chamber 220, as seen in FIG. 10. Once the first membrane 250*a* is ruptured, the first and second chambers 220, 230 are inserted axially into the third chamber 240, as seen in FIG. 11. In this way, the first container 211 slides into the second container 212. Stated differently, a squeezing force F4 is applied to the ends 228,246 of the containers 211, 212 such that the third chamber 240 slides axially towards the first and second chambers 220,230. This squeezing force F4 induces a relative axial movement between the first and second containers 211,212. In turn, this causes the applicator 290 to pass through the first membrane 250*a* and enter the first chamber 220 where the applicator 290 is submerged into the first flowable material 204. More specifically, the head 298 and the stem 297 of the swab 296 pierce the first membrane 250*a* and enter into the first chamber 220. The first flowable material 204 is absorbed by the applicator, in this case, the head 298 of the swab 296.

Next, an extraction force F5 in the opposite direction of the squeezing force F4 is applied to the removable cover 292 at the proximate end 246 of the third chamber 240, to separate the cover 292 from the remainder of the dispenser 210. As seen in FIG. 12, when the cover 292 is removed from the remainder of the second container 212, the applicator 290 which is attached to the cover 292 is also removed. During removal, the applicator 290 passes through the first and second membranes 250*a,b*, and out of the proximate end 246 of the third chamber 240. Specifically, the head 298 of the swab 296 passes through both membranes 250*a,b*, and out of the dispenser 210. It should be recognized that the cover 292 can be removably affixed to the proximate end 246 of the third chamber 240 through a variety of methods, including friction fit, or providing threads so that the cover 292 is secured onto the container 212.

Preferably, the first membrane 250*a* of the second preferred embodiment of the dispenser 210 is designed and configured to resist rupture from axial pressure, including that of the applicator 290. Thus, the dispenser 210 cannot be operated without first applying radial pressure through the application of force F3 to rupture the first membrane 250*a*. However, it should be understood that the first membrane 250*a* can be configured in such a manner such that it can be pierced by the applicator 290 alone, without the need for radial force F3 to be applied. In this way, only axial force F4 would be necessary, as the applicator 290, specifically the head 298 of the swab 296, would pierce the first membrane 250*a* as it passed through the membrane 250*a*.

Figure 13:
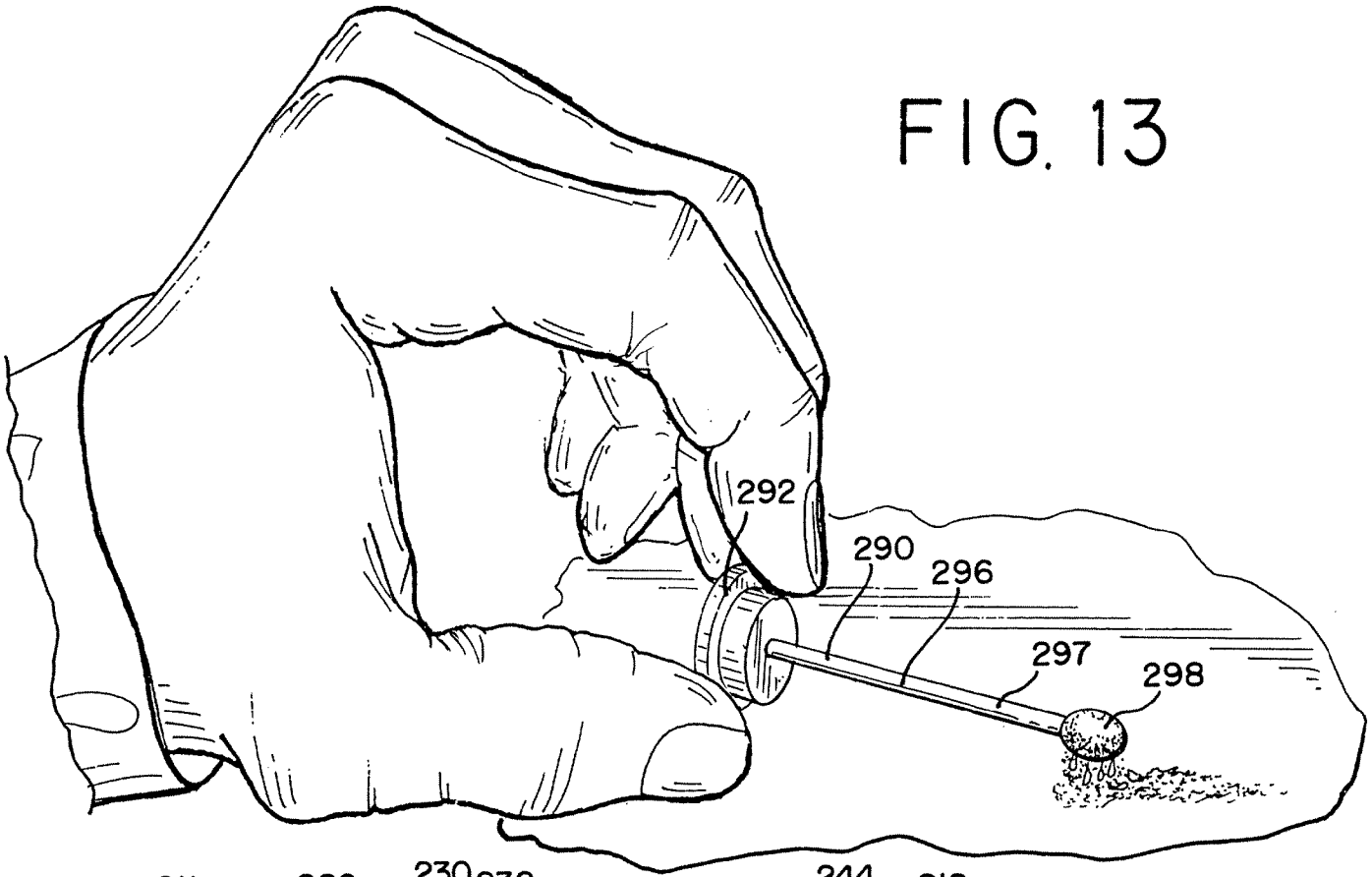
FIG. 13 is a perspective view of the dispenser of FIG. 12 showing the applicator in use by an operator.

Referring to FIG. 13, the applicator 290 can then be used to apply the first flowable material 204 to a surface. More specifically, in this second preferred embodiment, when the cover 292 is removed from the dispenser 210, the stem 297 and head 298 of the swab 296 are also removed, with the head 298 of the swab 296 having absorbed the first flowable material 204 from the first chamber 220. Thus, the swab 296 can be used by an operator to apply the first flowable material 204 to a surface by dabbing the head 298 of the swab 296 on the surface, as seen in FIG. 13.

Figure 14:
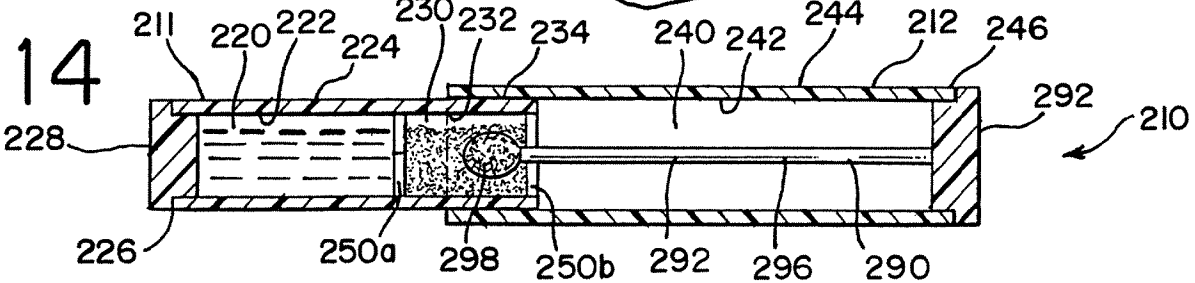
FIG. 14 is a cross-sectional view of the dispenser of FIG. 10 showing a second flowable material contained in a second chamber of the dispenser.

It should also be recognized that although the second preferred embodiment of the dispenser 210 is designed to be used with only one flowable material 204, it may alternatively be used to mix two or more flowable materials 204,205 to form a mixture which is then applied by the applicator 290. Referring to FIG. 14, a first flowable material 204 may be stored in the first chamber 220 while a second flowable material 205 is stored in the second chamber 230. As described above, the head 298 of the swab 296 is positioned within the second chamber 230, thus being exposed to the second flowable material 205. When the squeezing force F3 is applied, the first membrane 250*a* will rupture as explained above. The pierced or ruptured first membrane 250*a* allows the first and second flowable materials 204, 205 to flow between the first and second chamber 220,230 to form a mixture 206. This mixture 206 is absorbed by the applicator 290, specifically, the head 298 of the swab 297. The applicator 290 is then extracted by removal of the cover 292 on the proximate end 246 of the third chamber 240, as described above, and the mixture 206 is the applied with the applicator, as seen in FIG. 13.

A third preferred embodiment of the dispenser is shown in FIGS. 15-21, generally designated with reference numeral 310. Like elements will be referred to with similar reference numerals. As seen in FIG. 15, the third preferred embodiment of the dispenser 310 comprises a container 312 having an exterior wall 314, and interior wall 315, a first chamber 320, a second chamber 330, and a membrane, or web, 350. The exterior wall 314 defines the container 312, while the interior wall 315 separates the first and second chambers 320,330.

Referring now to FIGS. 15-18, the first chamber 320 has an interior surface 322, an exterior surface 324, an open distal end 326, and a closed proximate end 327. The proximate end 327 of the first chamber 320 is integrally formed with the exterior wall 314 of the container 312. The distal end 326 of the first chamber 320 can be closed by a number of sealing methods, including heat or adhesive sealing. However, preferably the distal end 326 receives a cap 328 to close the first chamber 320. Therefore, the first chamber 320 is formed, or defined, by the cooperation of the interior surface 322, the cap 328 at the distal end 226, and the proximate end 327. Stated differently, the first chamber 320 is formed by a portion of the exterior wall 314 of the container 312 and the interior wall 315 of the container. The first chamber 320 is adapted to receive and contain a first flowable material 304.

The second chamber 330 also has an interior surface 332 and an exterior surface 334, and a proximate end 336. Preferably, the proximate end 336 is open, as seen in FIG. 18. Thus, the second chamber 330 is formed, or defined, by its interior surface 332. Stated differently, the second chamber 330 is formed by a portion of the exterior wall 314 of the container 312 and the interior wall 315 of the container 312. Preferably, the first and second chambers 320,330 are of a one-piece construction. Additionally, the dispenser 310 includes an applicator 390 connected to the exterior wall 314 of the container 312, in communication with the second chamber 330. Preferably the applicator 390 is connected to the second chamber 330 at the proximate end 336 of the second chamber 330 so as to cover the opening therein, as seen in FIG. 18. In this third preferred embodiment, the applicator 390 is preferably a sponge 396 having a generally flat shape and cooperatively dimensioned with the proximate end 336 of the second chamber 330. However, as with all the embodiments of this invention, a large variety of applicators can be used, including pads, swabs, droppers, and nozzles. All that is important is that the applicator 390 be connected in communication with the proximate end 336 of the second chamber 330 where it can receive the flowable material.

The membrane 350 is positioned on the interior wall 315 of the container 312, between the first and second chambers 320,330. Thus, the chambers 320,330 are divided and separated by the membrane or web 350, best seen in FIG. 10, as well as the interior wall 315. The membrane 350 is constructed the same as in the dispenser 10 of the first preferred embodiment above. While all that is required is one membrane 350, as seen in FIG. 17, a plurality of membranes 350*a,b,c* positioned on the interior wall 315 between the chambers 320,330 and may be utilized to improve the flow of the first flowable material. If a plurality of membranes 350*a, b,c* is desired, it is preferable to distribute the membranes 350*a,b,c* evenly along the axis of the first chamber 320.

Figure 21:
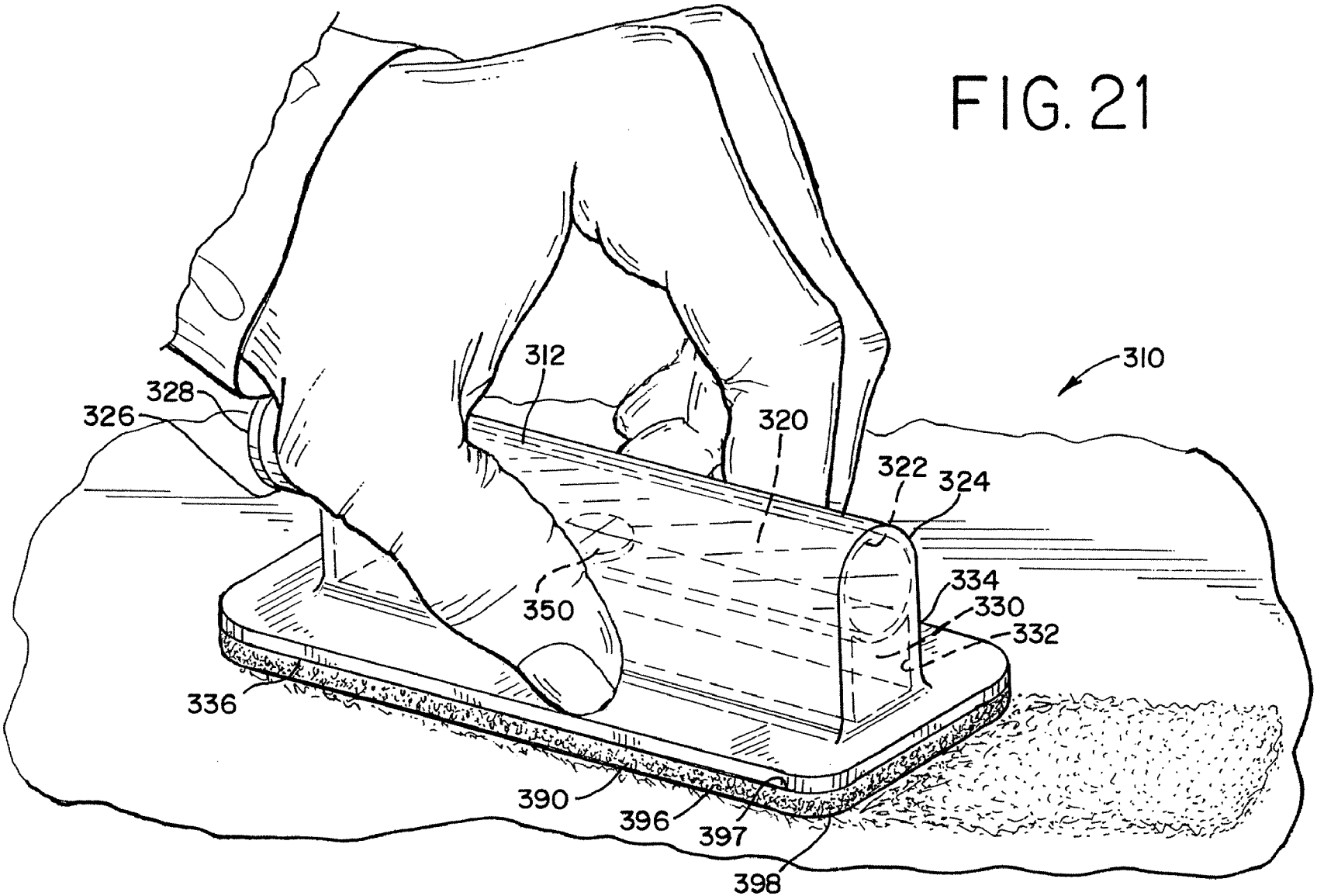
FIG. 21 is a perspective view of the dispenser of FIG. 15, showing the dispenser in use by an operator.

This third preferred embodiment of the dispenser 310 is preferably used to dispense only one flowable material 304, as shown in FIGS. 20-21. The material 304 is filled into the first chamber 320, and the chamber 320 is sealed at the distal end 326 with the cap 328. When the dispenser 310 is to be used, a squeezing force F6 is applied to the first chamber 320 adjacent to the membrane 350, as seen in FIG. 20. This causes the membrane 350 to rupture, as described above in relation to the first preferred embodiment. The ruptured membrane 350 allows the flowable material 304 in the first chamber 320 to pass from the first chamber 320 to the second chamber 330. Both the pressure created by the squeezing force F6 and gravity assist the flowable material in leaving the first chamber 320 and entering the second chamber 330. In the second chamber 330, the flowable material 304 is absorbed into the applicator 390, in this case the sponge 396. The sponge 396 absorbs the flowable material 304, and through capillary action, the material is transmitted from an interior surface 397 of the sponge 396 to an exterior surface 398 of the sponge 396, as seen in FIG. 20. Once the flowable material 304 reaches the exterior surface 398 of the sponge 396, it can be applied to a surface by an operator, as seen in FIG. 21. More specifically, the operator grasps the exterior surface 322 of the first chamber 320 which acts as handle. The operator then uses the dispenser 310 to apply the flowable material 304 by bringing the exterior surface 398 of the sponge 396 into contact with the surface, either through dabbing, wiping, or smearing. The exterior surface 398 of the sponge 396, which is laden with the flowable material 304, transfers the material 304 to the surface to which is to be applied.

It should also be recognized that although the third preferred embodiment of the dispenser 310 is designed to be used with only one flowable material 304, it may alternatively be used to mix two flowable materials to form a mixture which is then applied by the applicator 390. All that would be required is that a second flowable material be filled into the second chamber 330 before the second chamber 330 was sealed with the connection of the applicator 390. Thus, when the membrane 350 was ruptured, the first flowable material would flow from the first chamber 320 to the second chamber 330 (through the ruptured membrane 350), where a mixture of the first and second flowable materials would be formed. The mixture could then be applied in an identical fashion as described above, by the use of the applicator 390 on the desired surface, as seen in FIGS. 20 and 21. This embodiment might also include an additional cap over the applicator 390 to prevent leakage of the second flowable material through the applicator 390.

Furthermore, it should be clear that the first chamber 320 could be divided into a plurality of sub-chambers, each such sub-chamber being defined by the exterior wall 314 of the container 312, and a portion of the interior wall 315 of the container 312. In this way, each sub-chamber would have a separate membrane 350 on the interior wall 315 which, when ruptured, would permit fluid in such sub-chamber to flow into the second chamber 330. Thus, a plurality of flowable materials could be filled into these sub-chambers, and when the rupturing force F6 was applied, the plurality of membranes would rupture allowing the materials to flow from the sub-chambers, through the membranes and to collect in the second chamber 330, where a mixture would be formed. This mixture could then be applied in a similar fashion to the application technique described above for the third preferred embodiment of the dispenser 310.

FIGS. 22, 23 and 24 depict an alternative embodiment of a dispenser according to the present invention, generally designated with the reference numeral 410. The dispenser 410 is a multi-piece dispenser 410, and in the embodiment shown includes a first member 412 in the form of a container 412 and a second member 414 in the form of a closure member 414.

The container 412 is preferably in the form of a tube 412. The tube 412 is made from a first material and has a side wall 416 having a cylindrical shape with a generally circular cross section, although cross sections of other shapes are certainly possible to be used while remaining within the scope of the present invention. The side wall 416 has an open proximal end 418 and a distal end 420.

The closure member 414 is preferably in the form of a nozzle 414. The nozzle 414 includes a nozzle side wall 422 being cylindrically shaped and generally having a circular cross section, although cross sections of different shapes are certainly possible. The nozzle 414 further includes a membrane or web 424 generally perpendicular to a longitudinal axis of the nozzle side wall 422. The membrane 424 divides the nozzle 414 into a first portion 426 and a second portion 428. An exterior extension 430 is located on an outer surface of the nozzle side wall 422 to indicate the location of the membrane 424 within the nozzle side wall 422. The first portion 426 is larger than the second portion 428 and includes a stepped shoulder 432 defining a tapered surface. The first portion 426 also has a nozzle edge 433 at a proximal end.

The membrane 424 is of similar configuration and construction as the previously described membranes/webs. More specifically, the membrane 424 is generally disk shaped and includes a weld seam 434. The weld seam 434 is adapted to rupture upon the application of a force to the side wall 422 at the point of the weld seam 434. The membrane 424 is formed using the process described in U.S. Pat. No. 6,641,319, which is expressly incorporated by reference and made a part hereof.

The tube 412 is formed by extruding the first material into a desired shape and configuration. The distal end 420 may be sealed or closed by any known manner. For instance, a cap 411 may be provided or the end 420 may be heat sealed or sonically welded. A liquid or other substance may then be placed within the tube 412. The stepped shoulder 432 of the nozzle 422 is then positioned with respect to the tube 412 as shown in FIG. 23 so that the nozzle edge 433 abuts the open proximal end 418 to define a seal area or interface area 435. It is noted that the size and shape of the stepped shoulder 432 generally corresponds to the size and shape of the open proximal end 418 of the tube 412 such that the nozzle edge 433 generally aligns with the open end 418. Then a seam 440 to form a seal area 435 (FIG. 24) is formed between the nozzle edge 433 and the proximal open end 418 of the tube 412 utilizing an ultrasonic welding method, spin welding method, heat sealing, or by using an adhesive or chemical bonding agent. Other methods known to those skilled in the art may be used. Other methods of forming the seam may also be utilized to form a hermetic seal between the nozzle edge 433 and the proximate end 418.

It is further noted that the nozzle 414 may be sealed to the open end 418, and then the tube 416 may be filled with a flowable material prior to capping or closing the distal end 420.

In this way an interior of the tube 412 and an interior of the first portion 426 of the nozzle 414 combine to form a chamber 442 for holding, storing and/or transporting the liquid or other substance until such time as dispensing is required. To dispense any liquid or other substance contained within the chamber 442, a user would squeeze the nozzle side wall 422 generally at the exterior extension 430 exerting a radial force on the membrane 424 thereby causing the membrane 424 to rupture. This allows the liquid or other substance to pass out of the chamber 440, past the membrane 424 and through the second portion 428 of the nozzle 422.

Previous dispensers 10 disclosed herein and described above have generally been of a one-piece construction formed from a flexible thermoplastic material, such as a polyethylene or polypropylene, utilizing an injection molding process. In preferred embodiments of the invention, the dispenser can be formed from chemically-resistant grades of polypropylene and polyethylene as well as blends of both such materials. Other suitable polymeric materials can also be used including but not limited to P.E.T.G. However, it has been found, as is generally known in the art, that when injection molding that portion of the dispenser that has previously been described as the container 412 over any substantial length, the material used becomes chemically stressed. There is more shear stress present in this portion of the dispenser. This, in turn, results in the container 412 becoming more susceptible to being broken down, or chemically interacting with the anticipated contents of the container 412. Because the injected-molded membrane is a typically more compact part, and does not have a substantial length such as the length of the container, the membrane is not susceptible to such undue stressing. The membrane itself has less stress.

Therefore, it can be seen that the present invention, particularly the multi-piece dispenser 410 disclosed and described herein, permits the second member or closure member 414 to be injection molded and further permits the container 412 to be extruded. This is advantageous as the previously described chemical stressing resulting from the injection molding process, does not result from the extrusion process. Therefore, the container 412 resulting from the extrusion process will retain substantially all of its resistance to chemical interaction with the anticipated contents, as compared to attempting to injection mold the container 412. It is anticipated that the container 412 may be extruded from any chemically resistant material, particularly, but not limited to, chemically resistant grades of polypropylene or polyethylene, as well as blends of both. The container 412 may also be formed of any other chemically resistant polymeric material also preferably suitable for an extrusion process.

FIG. 25 discloses an additional embodiment of a multi-piece dispenser 610. The dispenser 610 is similar to the dispenser 410 of FIGS. 22, 23 and 24 except that it incorporates an extruded tube 612 that is of a laminated construction. That is, the tube 612 includes an outer side wall 616 and an inner side wall 617. The tube may be formed by co-extruding the inner and outer sidewalls 616, 617, or by extruding the outer sidewall 616 and applying the inner sidewall 617 to the outer sidewall 616 by any known means. The inner sidewall 617 may comprise a coating, as well. The nozzle 614 of the dispenser 610 also includes a stepped shoulder 632 having a nozzle edge 633. In assembly, the nozzle edge 633 is welded to the outer tube side wall 616 in a manner as previously described, such as sonically welding or otherwise creating a seal between the two.

FIG. 26 discloses yet an additional embodiment of a multi-piece dispenser 510. The dispenser 510 includes an extruded tube 512 and a nozzle or tube head 514. However, the nozzle 514 does not include a stepped shoulder portion. Rather, the overall diameter of the nozzle 514 is contiguous with that of the tube 512. In all other respects, including the rupturable membrane 424, the dispenser 510 is similar to the dispenser of FIGS. 22, 23, and 24.

The embodiment of the dispenser 510 shown in FIG. 26 also includes a laminated construction wherein the tube 512 includes an outer wall 516 and an inner wall 517. The inner wall 517 may comprise a layer of foil adhered to or otherwise bonded or attached to the outer wall 516.

Figure 27:
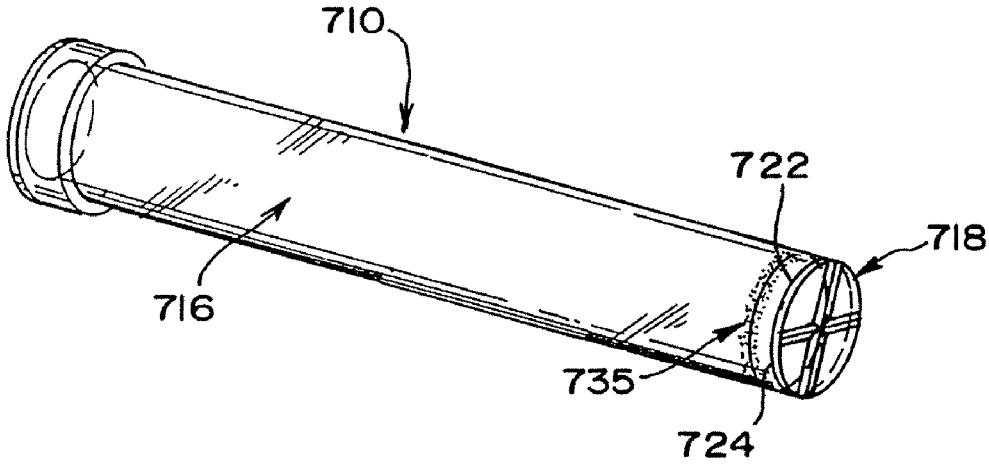
FIG. 27 is perspective view of yet an additional alternative embodiment of a two piece dispenser according to the present invention.

FIG. 27 shows an additional embodiment of a two piece dispenser 710. The dispenser 710 includes a tube 716 and a closure member 718. The closure member 718 includes a membrane 724 as previously described and further includes a side wall 722. The side wall 722 is sealed to the tube 716 as previously described. In this embodiment, the closure member 718 may generally be considered disk shaped wherein the disk is sealed to the open end of the tube 716. Thus, a seal area 735 is defined at this area of connection between the tube 716 and the closure member 718. No other structure exists on a side of the closure member 718 opposite the seal area 735.

Figure 28:
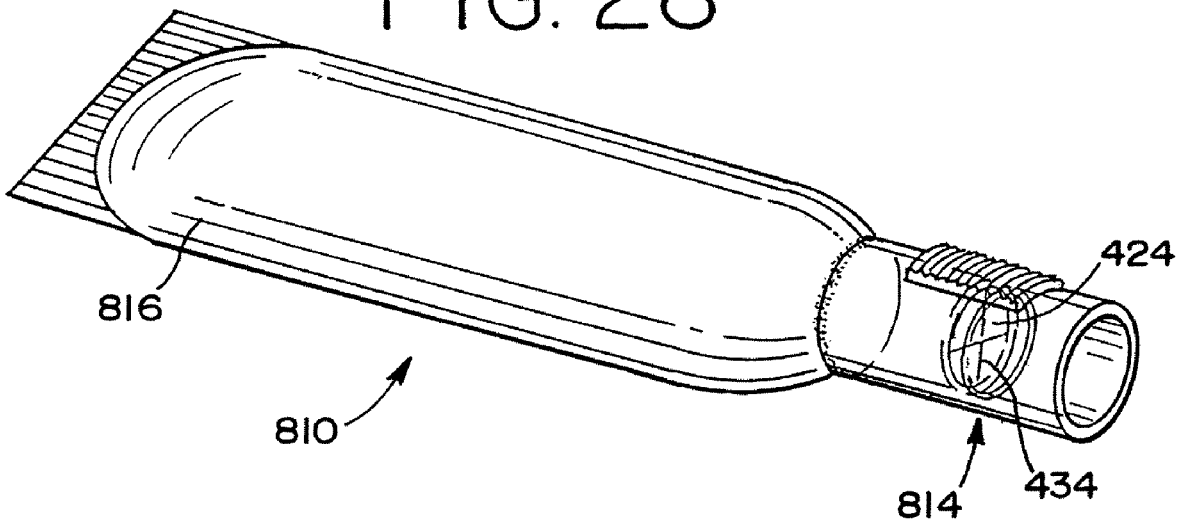
FIG. 28 is a perspective view of yet an additional alternative embodiment of a two piece dispenser according to the present invention.
Figure 29:
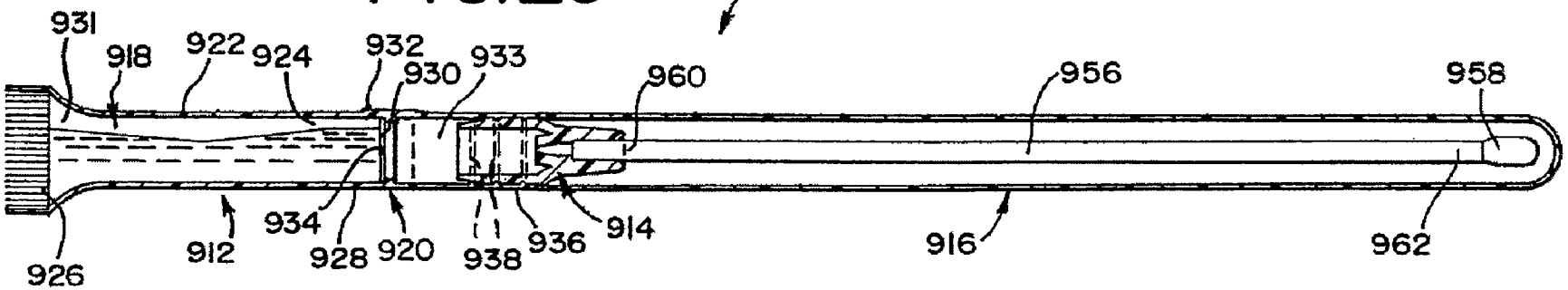
FIG. 29 is a side view of an additional alternative embodiment of a dispenser according to the present invention including a dropper assembly and a swab assembly.
Figure 30:
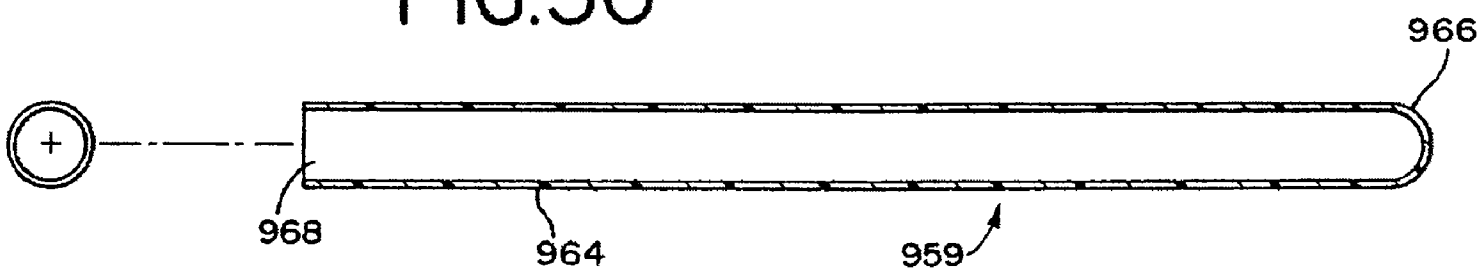
FIG. 30 is a side view of a cover tube of the swab assembly of FIG. 29.
Figure 31:
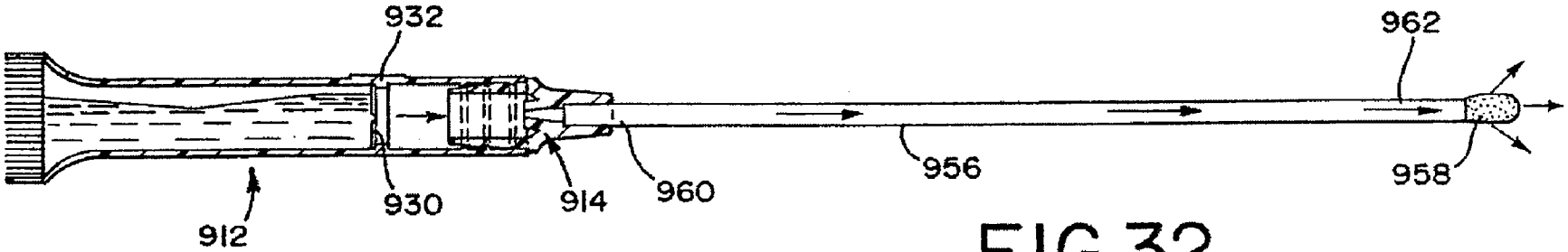
FIG. 31 is a side view of the dispenser of FIG. 29.
Figure 32:
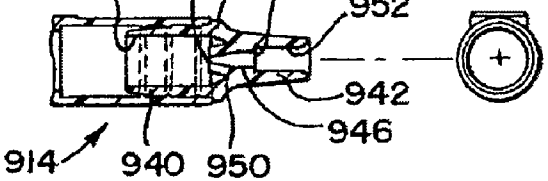
FIG. 32 is a side view of the dropper assembly.

FIG. 28 shows an additional embodiment of a two piece dispenser 810. The dispenser 810 includes a flexible and pliable generally cylindrical tube 816 and a nozzle 814 sealed thereto. The nozzle 814 includes a membrane 424 as previously described including a weld seam 434. In some preferred embodiments, the tube 816 can be of foil material or similar to a conventional tooth paste tube.

It can be seen that the two piece embodiments of the dispenser as described in exemplary fashion above permit the advantageous use of two different materials to form the dispenser. One of the materials is more compatible with the flowable substance anticipated to be used with the dispenser. The other of the materials is more compatible with the injection molding process which is generally preferred to be used in forming the membrane and weld seams as discussed above.

FIGS. 29-32 depict an alternative embodiment of a dispenser 910 according to the present invention. The dispenser 910 includes a container assembly 912, a dropper tip assembly 914 and a swab assembly 916. The container assembly 912 includes a container body 918 and a closure member 920. The container body 918 is generally of tubular construction and has a side wall 922. The container body 910 has a first end, or closed or sealed end 926, and a second end 924, that is an open end 924.

The closure member 920 includes a closure side wall 928 generally contiguous with the container side wall 922, a rupturable membrane or web 930 and an exterior extension 932. The web 930 is generally perpendicular to a length of the overall dispenser 910. The membrane or web 930 is preferably located between the first end 926 and the second end 924. The web 930 is of similar configuration and construction as the previously described membranes/webs. More specifically, the membrane 930 is generally disk shaped and includes at least one weld seam 934. The weld seam 934 is adapted to rupture upon the application of an opposed force to the side wall 928 in the vicinity of the weld seam 934. The web 930 is preferably formed using the process described in U.S. Pat. No. 6,641,319, which is expressly incorporated by reference and made a part hereof. The exterior extension 932 is located proximal to the location of the web 930 to indicate to a user the location of the web 930 and to further indicate a proper location to apply a force for the purpose of rupturing the membrane 930, to be further described. The closure member 920 further includes a mating end 936 adapted to receive the dropper assembly 914. More specifically, the mating end 936 includes a plurality of interior ridges 938. A first chamber 931 is defined between the membrane 930 and the closed end 926. In one preferred embodiment, a second chamber is defined between the membrane 930 and the open end 924.

It is noted that in FIGS. 29-32, the container body 918 and closure member 920 are shown as being a unitary, singularly one piece construction. However, it is understood, that the closure member 920 may be separately constructed from the container body 918 and later be joined, similar to previously described embodiments. For instance, the closure member 920 may be injection molded of one material, and the container body 918 may be extruded of another material. A seam 440 (see FIG. 24) may be formed between the container body 918 and the closure member 920 as previously described to form a seal area 435.

The dropper assembly 914 as shown is of a one piece construction and includes a male end 940 and a female end 942, that also may be referred to as a distal end. The male end 940 has a diameter sized and shaped such that the male end 940 may be received by the mating end 936 of the closure member 920. Preferably, the mating end 936 and the male end 940 are adapted such that the male end 940 is friction fit within, and retained by, the mating end 936. The male end 940 may include a plurality of external grooves (not shown specifically, but seen generally in FIG. 32), wherein each external groove may be adapted to mate with one of the plurality of interior ridges 938. The male end 940 further includes a male end bore 944.

The female end 942 has an outer diameter that tapers to a smaller diameter than that of the male end 940. Between the male end 940 and female end 942 is a collar portion 941. The female end 940 includes a female bore 946 including a step wall 948 and a conical wall 950. The step wall 948 defines, in part, a swab receptacle 952 adapted to receive the swab assembly 916, to be explained. The conical wall 950 includes a small orifice 954 at one end, such that the male end bore 944, small orifice 954 and female bore 946 are all in flow communication with one another. In construction and design, the size of the small orifice 954 may be adjusted or designed, to partially control the ease with which a fluid or other flowable substance may flow through the dropper assembly 914. The dropper assembly can be operated by squeezing as is known to control fluid flow.

The swab assembly 916 includes a tube or hollow shaft 956, an applicator or swab 958 and a cover tube 959. The tube 956 is generally hollow and is received by the female end 942 of the dropper assembly 914 at a first end 960 of the tube 956. The applicator 958 is operably connected to a second end 962 of the tube 956. The diameter or cross section of the tube 956 is sized and shaped such that the first end 960 is received by the swab receptacle 952 portion of the dropper assembly 914. The first end 960 is friction fit to, and thereby held, by the swab receptacle 952 of the dropper assembly 914.

The applicator 958, or applicator tip 958, is shown generally as a swab made of an absorbent material. The applicator 958 is shown schematically in FIGS. 29 and 31 as being connected to the second end 962 of the tube 956. It may be a cotton swab, a portion of which is friction fit within the second end 962. Additionally, a cotton swab may be connected by any other means commonly known in the art, such as adhesives, chemical bonding or any other means. Also, the swab may be constructed of a synthetic absorbent material. Additionally, the applicator 958 may be similar to a brush or be of any other construction so long as the applicator 958 is adapted to apply any contents of the dispenser 910.

The cover tube 959 has a cover side wall 964, a cover end wall 966 and an open end 968. The cover tube 959 is adapted to enclose the tube 956 and applicator 958. The open end 968 is sized and shaped to tightly fit over the collar portion 941 of the dropper assembly 914.

In assembly, the container assembly 912 is filled with a fluid or other flowable substance or material, through the sealed end 926, prior to sealing. The sealed end 926 is then sealed and the fluid is then retained between the sealed end 926 and membrane 930 within the chamber 931. The male end 940 of the dropper assembly 914 is inserted into the mating end 936 of the closure member 920 such that the plurality of interior ridges 938 are received by any corresponding grooves that may be present on the male end 940 of the dropper assembly 914. The first end 960 of the tube 956 is inserted into the swab receptacle 952 of the female end 942 of the dropper assembly 914 and frictionally retained therein. The cover tube 959 is then placed about the tube 956 and applicator 958 such that the cover open end 968 is frictionally fit over and about the collar portion 941 of the dropper assembly 914. Thus, the cover tube 959 is removably connected to the container assembly or dropper assembly as desired. It is understood that tamper evident sealing structures could be used with the connection structure for the cover tube 959.

In application, a user could remove the cover tube 959 by pulling on the tube 959. The user would then apply an opposed force to the body side wall 922 at or near the exterior extension 932 thereby rupturing the membrane 930. This will permit fluid to flow past the membrane 930 and towards the male end bore 944. The orifice 954 will permit the fluid to flow there through, past the conical wall 950 and through the remainder of the female end bore 946. The dropper assembly 914 may be squeezed to assist in fluid flow through the assembly 914. The fluid may then flow through the tube 956 towards its second end 962 where it will eventually saturate, or partially saturate the applicator 958. Fluid may then be applied to an applicator site by rubbing or pressing the applicator 958 on said site.

If the user wishes to increase the flow of fluid towards the applicator 958, the user may squeeze the body side wall 922 of the container body 918 thereby forcing more fluid to flow past the membrane 930, through the dropper assembly 914, though the tube 956 and to the applicator 958. As discussed, the dropper assembly 914 may also be squeezed. Also, it can be seen that use of a dropper assembly 914 having a larger orifice 954 may also increase the ability of the fluid to flow towards the applicator 958. It can be seen that a flow path is established from the chamber 931, through the ruptured membrane 930, mating end 936, male end bore 940, orifice 954, female end bore 942, tube 956 and to the applicator 958.

It should be noted, that the container assembly 912 may be constructed of additional length and include a plurality of webs 930 for dispensing a plurality of fluids, either in series, or in mixture. The dropper assembly 914 may be connected to the container assembly 912 by any known means, including a threaded connection, friction fitting of different design than described above, adhesive or chemical bonding, or various types of welding. Additionally, the dropper assembly 914 may be constructed of a single unitary piece of construction along with the container assembly 912. The tube 956 of the swab assembly 916 may be connected to the dropper assembly 914 by any known means such as a threaded connection, glue or chemical bonding, welding, or any other means known in the art. In some instances the swab assembly 916 may be connected directly to the container assembly. The swab assembly 916 may be dimensioned of any variety of lengths as may be desired. The cover tube 959 may be connected to the collar portion 941 by any known means including a threaded connection, adhesive or other chemical bonding, other friction fitting or by any other known means. Additionally, there may be a preformed frangible connection between the cover tube 959 and either the collar portion 941 or directly with the container assembly 912.

The dispenser 910 may be used in a variety of applications. In one preferred embodiment, the dispenser 910 may be used in a medical setting such as in obtaining a throat culture to detect if a patient has strep throat. In this case, after removing the cover tube 959, the user would swab a patient's throat by rubbing the applicator in the throat at an appropriate location to therefore obtain a "throat culture." The user could then rupture the membrane 930 as described and permit the flowable substance to flow towards the applicator as previously described. In this case, the flowable substance will include an agent that reacts, perhaps by a variation in color, in the presence of the strep virus. When the flowable substance reaches the applicator, the user will be able to tell if the patient has strep throat. That is, if the patient has strep throat, the virus indication will be located on the applicator by virtue of having taken the described culture or swab of the patient's throat. The virus located on the applicator 958 will react with the reagent in the flowable substance resulting in a visually detectable change in color, indicating the presence of strep throat.

Figure 33:
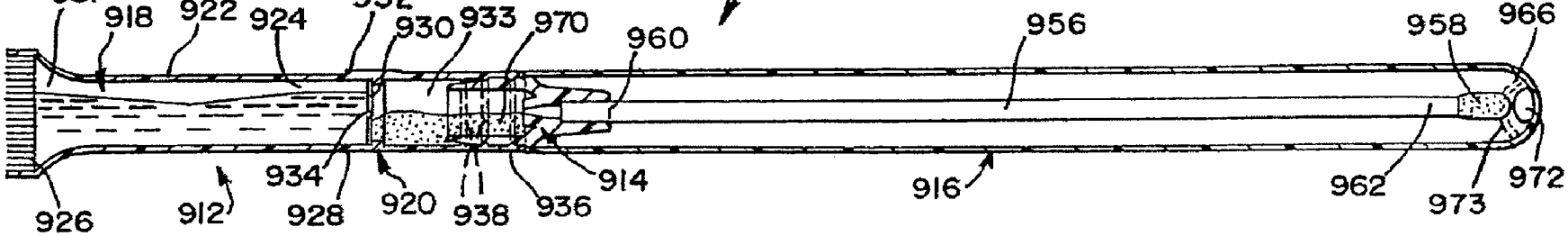
FIG. 33 is a side view of an additional alternative embodiment of a dispenser according to the present invention also including a dropper assembly and a swab assembly.

FIG. 33 depicts another preferred embodiment of a dispenser 910 according to the present invention. The dispenser 910 of FIG. 33 is similar in many respects to that described in connection with FIGS. 29-32. Accordingly, features of the dispenser 910 of FIG. 33 that are similar to the previously described embodiment are referenced with the same reference numerals as utilized for the embodiment of FIGS. 29-32. Only the differences between the two embodiments will be discussed.

Similar to the above, the dispenser 910 of FIG. 33 includes a container assembly 912, a dropper assembly 914 and a swab assembly 916. The container assembly 912 also has the first end and the second end with the rupturable membrane 930 positioned therebetween. The chamber 931 of the container body 918 contains a first flowable substance. A second chamber 933 is defined between the membrane 930 and the dropper assembly 914. A second flowable substance 970 is stored in the second chamber 933. In one preferred embodiment, the second flowable substance 970 is a powder. The applicator or swab 958 of the dispenser 910 of FIG. 33 is similar to that of FIGS. 29-32 except that in the embodiment of FIG. 33, the applicator 958 is impregnated with a reactive agent, as schematically indicated in FIG. 33. Additionally, a third material in the form of a pellet 972 is included in the cover tube 959. Alternatively, a reactive pad 973 can be attached to an inner surface of the cover end wall 966. The reactive pad 973 can be impregnated with a reactive agent.

The dispenser 910 of FIG. 33 may be used to test for the presence of various substances, viruses, drugs or other compounds. In some applications, the testing solution used may not be stable. In this case, the various ingredients of the solution may need to be stored separately and then mixed immediately or shortly before use. For example, in one form of the invention, two materials may initially be required to be separate and later mixed and then applied to another surface or material for testing. To this end, the first flowable substance may be in the form of a diluent contained in the first chamber 931. The applicator tip 958 may be impregnated with the second substance or material. The membrane 930 may be ruptured to allow the diluent to flow into the applicator 958 to form a mixture or solution. The applicator 958 may then be swabbed on a surface to detect for a further substance. The applicator 958 could also have been swabbed on a surface first and the membrane 930 subsequently ruptured. Thus, the solution or mixture that has flowed to the applicator 958 as previously described will react if the substance being tested for is present on the applicator 958. Based on the reaction of the various materials, some "indication" will be present or not present from the dispenser. In one preferred embodiment, the indication will be a visual indication. It will be understood that other sensory indications are possible. Similarly, the second flowable material may be in powder form and contained in the second chamber 933. The diluent can then mix with the powder to form a mixture that is delivered to the applicator tip 958. In still other examples, it may be that the testing solution to be used for a particular purpose requires additional or multiple substances. In this case, additional materials may be impregnated in the applicator 958 or otherwise used in the dispenser. For example, the pellet 972 or reactive pad 973 may also hold a reactive agent. Finally, it will be understood that the powder 970, impregnated applicator 958 and pellet 972 or reactive pad 973 may be used alone or in any combination with the dispenser 910 for the testing use described herein. Thus, it is understood that depending on the testing parameters for the dispenser 910, all or only some of the above described materials may be used in the dispenser 910.

It is further under stood that the dispenser 910 of FIGS. 29-33 may be used for a variety of testing applications, including, but not limited to testing for strep throat, pregnancy, HIV, presence of drugs, explosives or contraband, presence of blood or other bodily fluids, specific materials testing as well as diabetes applications or any other testing application where a test sample may be obtained by rubbing the applicator 958 on a test site.

The multi-chambered design of the dispenser 10 of the current invention offers uses in a large variety of different applications. The dispenser 10 can be used to dispense flowable materials that combine to form mixtures for many different substances. In addition, the dispenser 10 can be configured with only one membrane 50*a* to dispense a single flowable material, for example, the dispenser 10 shown in U.S. Pat. No. 6,641,319.

The dispenser 10 is designed to primarily contain and dispense flowable materials that are fluids. Other flowable materials can also be used. This permits the dispenser 10 to be used in a wide variety of uses, and contain and dispense a large variety of fluids and other flowable substances. In one example, the dispenser 10 can be used to in a two-part hair care product such as a hair dye kit. A first flowable substance of the hair dye kit can be carried in the first chamber, and a second flowable substance of the hair dye kit can be carried in the second chamber. The membrane is ruptured wherein the two flowable substances can be mixed together to form a mixture or solution. The mixture or solution can then be dispensed from the dispenser onto the hair of a user. In a multitude of other examples, the dispenser 10 can dispense a flowable material or mixture that is an adhesive, epoxy, or sealant, such as an epoxy adhesive, craft glue, super glue, leak sealant, shoe glue, ceramic epoxy, fish tank sealant, formica repair glue, tire repair patch adhesive, nut/bolt locker, screw tightener/gap filler, super glue remover or goo-b-gone. Also, the dispenser 10 can dispense a flowable material or mixture that is an automotive product, such as a rear view mirror repair kit, a vinyl repair kit, an auto paint touch up kit, a window replacement kit, a scent or air freshener, a windshield wiper blade cleaner, a lock de-icer, a lock lubricant, a liquid car wax, a rubbing compound, a paint scratch remover, a glass/mirror scratch remover, radiator stop-leak, or a penetrating oil. The dispenser 10 can also dispense a flowable material or mixture that is a chemistry material, such as a laboratory chemical, a fish tank treatment, a plant food, a cat litter deodorant, a buffer solution, a rehydration solution, a biological stain, or a rooting hormone.

Moreover, the dispenser 10 can dispense a flowable material or mixture that is a cosmetic, fragrance or toiletry, such as nail polish, lip gloss, body cream, body gel, hand sanitizer, cologne, perfume, nail polish remover, liquid soaps, skin moisturizers, tooth whiteners, hotel samples, mineral oils, toothpastes, or mouthwash. The dispenser 10 can also dispense a flowable material or mixture that is an electronics product, such as a cleaning compound, a telephone receiver sanitizer, a keyboard cleaner, a cassette recorder cleaner, a mouse cleaner, or a liquid electrical tape. In addition, the dispenser 10 can dispense a flowable material or mixture that is a food product, such as food colorings, coffee flavorings, spices, food additives, drink additives, confections, cake gel, sprinkles, breath drops, condiments, sauces, liquors, alcohol mixes, or energy drinks. The dispenser 10 can also dispense a flowable material or mixture that is a hair care product, such as hair bleaches, hair streaking agent, hair highlighter, shampoos, hair colorants, conditioners, hair gels, mousse, hair removers, or eyebrow dye. The dispenser 10 can also dispense a flowable material that is a home repair product, such as a caulk, a scratch touch up kit, a stain remover, a furniture repair product, a wood glue, a patch lock, screw anchor, wood tone putty or porcelain touch-up.

In addition, the dispenser 10 can dispense a flowable material or mixture that is a test kit, such as a lead test kit, a drug kit, a radon test kit, a narcotic test kit, a swimming pool test kit, a home water quality tester, a soil test kit or a gas leak detection fluid. The dispenser 10 can dispense a large variety of lubricants including industrial lubricants, oils, greases, graphite lubricants or a dielectric grease. The dispenser 10 can also dispense a flowable material or mixture that as part of a medical device test kit, such as a culture media, a drug monitoring system, a microbiological reagent, a streptococcus test kit, or a residual disinfectant tester. In addition, the dispenser 10 can dispense a large variety of medicinal products, such as blister medicines, cold sore treatments, insect sting and bit relief products, skin cleaning compounds, tissue markers, topical antimicrobials, topical demulcent, treatments for acne such as acne medications, umbilical area antiseptics, cough medicines, waterless hand sanitizers, and toothache remedies. Furthermore, the dispenser 10 can dispense a flowable material or mixture that is a novelty product, such as a chemiluminescent light, a Christmas tree scent, a glitter gel, a face paint, novelty paints, paint additives, wood stain samples, caulk, paint mask fluid or paint remover. The dispenser 10 can also dispense a flowable material or mixture that is a personal care product, such as shaving cream or gel, aftershave lotion, skin conditioner, skin cream, skin moisturizer, petroleum jelly, insect repellant, personal lubricant, ear drops, eye drops, nose drops, corn medications, nail fungal medication, aging liquids, acne cream, contact lens cleaner, denture repair kit, finger nail repair kit, liquid soaps, sun screen, lip balm, tanning cream, or self-tanning solutions. A large variety of pest control products can be dispensed by the dispenser 10, including insect attractants, pesticides, pet medications, pet insect repellants, pet shampoos, pest sterilizers, lady bug attractant, fly trap attractant. Various safety products can be dispensed through the dispenser 10 including respirator tests and eye wash solution.

The dispenser 10 can also dispense a large variety of stationery or craft products, such as magic markers, glitter gels, glitter markers, glitter glues, gel markers, craft clues, fabric dyes, fabric paints, permanent markers, dry erase markers, dry eraser cleaner, glue sticks, rubber cement, typographic correction fluids, ink dispensers and refills, paint pens, counterfeit bill detection pen, envelope squeeze moisturizers, adhesive label removers, highlighters, and ink jet printer refills. The dispenser 10 can also dispense various vitamins, minerals, supplements and pet vitamins. The dispenser 10 can also dispense a flowable material or mixture for aroma therapy products, breathalyzer tests, wildlife lures, eyeglass cleaners, portable lighting fuels, bingo and other game markers, float and sinker devices, toilet dyes and treatments, dye markers, microbiological reagents, shoe polishes, clothing stain removers, carpet cleaners and spot removers, tent repair kits, plumbing flux applicator, rust remover, tree wound treatment, animal medicine dispenser, animal measured food dispenser, odor eliminator liquids, and multi-purpose oils. In addition, the dispenser 10 can be used as, or in connection with a suction device for culture sampling, taking various liquid samples, taking various swabbing samples and for acting as a chemical tester, such as may be used for testing drinks for various "date rape" drugs. In addition, the dispenser 10 can dispense a variety of sports products including sports eye black, football hand glue, and baseball glove conditioner. The dispenser 10 can dispense any variety of flowable materials including liquids and powders, and further including a liquid and a powder, two or more powders, or two or more liquids. The dispenser 10 may be used as part of 2-part system (mix before use) including a liquid with a powder, a liquid with a liquid, a powder with a powder, or sealed inside another tube or product container or partially sealed, connected or attached to another container. The dispenser 10 may also be used as part of a plunger dispensing system.

The dispenser 10 of the present invention may also be used for windshield wiper blade cleaner and other automotive applications, fragrances, pastry gels, eyebrow dye, paints, hair paints, finger nail repair kit, animal medicine dispenser, animal food dispenser, culture media samples, drug test kits, and chemical testers (e.g. date rape etc.).

While the invention has been described in its preferred embodiments, it is to be understood that the words which have been used are words of description rather than limitation and that changes may be made within the purview of the appended claims without departing from the true scope and spirit of the invention in its broader aspects. As an illustration, although the applicator has been described as being utilized for mechanical uses, it can similarly be used for applying adhesives, mastic or the like.

What is claimed is:

1. A dispenser for dispensing a flowable material, the dispenser comprising:

a container having a side wall and further having a closed end and an open end;

a membrane defining a chamber within the container between the membrane and the closed end of the container, the membrane having a weld seam, wherein the membrane is formed by a plurality of abutting segments of injected molded material to form the weld seam, wherein the weld seam is rupturable upon the application of a force to the side wall of the container proximate the membrane;

a swab assembly operably connected to the open end of the container such that the swab assembly is in flow communication with the open end, wherein the swab assembly comprises an elongated member having a first end extending from the container and a second end having an applicator, the applicator located away from the container.

2. The dispenser of claim 1 further comprising a dropper assembly having a first end operably connected to the open end and having a second end operably connected to the swab assembly, the dropper assembly further having a bore there through in flow communication with the open end and the swab assembly.

3. The dispenser of claim 2 wherein the swab assembly further comprises a cover tube having an open end attached to a collar portion of the dropper assembly, and wherein the elongated member comprises a tube, the cover tube further having a side wall enclosing the tube and applicator.

4. The dispenser of claim 2 wherein the first end of the dropper assembly is a male end that is frictionally received by the open end and the second end of the dropper assembly being a female end wherein the swab assembly comprises a tube having a first end frictionally received by the female end of the dropper assembly, the swab assembly further having an applicator attached to a second end of the tube such that the swab is in flow communication with the open end.

5. The dispenser of claim 1 wherein the applicator comprises an absorbent material.

6. The dispenser of claim 1 further comprising a cover dimensioned to be positioned over the swab assembly and being removably connected to the container.

7. The dispenser of claim 1 wherein the container and membrane are of a one-piece construction wherein the chamber is hermetically-sealed.

8. A dispenser for dispensing a flowable material, the dispenser comprising:

a container assembly having a container body having a closed end and an open end, and a closure member sealed to the open end, the closure member having a membrane defining a chamber between the membrane and the closed end, the chamber adapted to hold the flowable material, the membrane further having a weld seam adapted to rupture upon the application of an opposed force proximate the membrane, the closure member further having a mating end;

a dropper assembly having a male end received by the mating end, a female end and a collar portion disposed between the male end and the female end, the dropper assembly having a bore extending there through having a male end bore at the male end and a female end bore at the female end and further having an orifice disposed between the male end bore and the female end bore, the female end bore defining a receptacle; and a swab assembly having a hollow tube having a first end received by the receptacle and a second end located away from the container, the swab assembly further having an applicator attached to a second end of the tube, the applicator adapted to dispense the flowable material, the swab assembly further having a cover tube having an open end removably attached to the collar portion and having a side wall enclosing the tube and applicator, wherein a flow path is defined from the open end and through the male end bore, orifice, female end bore, tube and to the applicator.

9. A dispenser comprising:

a container having a side wall and further having a closed end and an open end;

a membrane connected to the side wall in a one piece construction wherein a hermetically-sealed chamber is defined within the container between the membrane and the closed end of the container, the chamber holding a flowable material, the membrane having a weld seam, wherein the membrane is formed by a plurality of abutting segments of injected molded material to form the weld seam, wherein the weld seam is rupturable upon the application of a force to the side wall of the container assembly proximate the membrane; and a swab assembly having an elongated hollow tube having a first end operably connected to the open end of the container assembly and having an applicator located at a second end of the tube such that the applicator is in flow communication with the open end, wherein the length of the elongated hollow tube is greater than the length of the container.

10. The dispenser of claim 9 wherein the flowable material comprises a diluent and further comprising a solid material located in a second chamber formed between the membrane and the swab assembly.

11. The dispenser of claim 10 wherein when the membrane is ruptured the diluent mixes with the solid material to form a test solution.

12. The dispenser of claim 9 wherein the flowable material comprises a diluent and the applicator is adapted to retain a culture such that when the membrane is ruptured the diluent reacts with the culture on the applicator to indicate a condition.

13. A dispenser for dispensing a flowable material, the dispenser comprising:

a container having a side wall and further having a closed end and an open end;

a membrane defining a chamber within the container between the membrane and the closed end of the container, the membrane having a weld seam rupturable upon the application of a force to the side wall of the container proximate the membrane;

a swab assembly operably connected to the open end of the container such that the swab assembly is in flow communication with the open end, wherein the swab assembly comprises an elongated member having a first end extending from the container and a second end having an applicator, the applicator located away from the container; and a dropper assembly having a first end operably connected to the open end and having a second end operably connected to the swab assembly, the dropper assembly further having a bore there through in flow communication with the open end and the swab assembly, wherein the first end of the dropper assembly is a male end that is frictionally received by the open end and the second end of the dropper assembly being a female end wherein the swab assembly comprises a tube having a first end frictionally received by the female end of the dropper assembly, the swab assembly further having an applicator attached to a second end of the tube such that the swab is in flow communication with the open end.

* * * * *